US011725421B1

(12) United States Patent
White

(10) Patent No.: US 11,725,421 B1
(45) Date of Patent: Aug. 15, 2023

(54) ATTACK, BALLISTIC AND BLAST RESISTANT SELF-LOCKING DOOR

(71) Applicant: Norshield Security Products, LLC, Montgomery, AL (US)

(72) Inventor: Barry White, Prattville, AL (US)

( * ) Notice: Subject to any disclaimer, the term of this patent is extended or adjusted under 35 U.S.C. 154(b) by 160 days.

(21) Appl. No.: 17/224,515

(22) Filed: Apr. 7, 2021

(51) Int. Cl.
*E05B 63/20* (2006.01)
*E05C 9/04* (2006.01)
(Continued)

(52) U.S. Cl.
CPC ..... *E05B 63/202* (2013.01); *E05B 15/0255* (2013.01); *E05B 15/04* (2013.01);
(Continued)

(58) Field of Classification Search
CPC ..... Y10T 292/0843; Y10T 292/68; Y10T 292/683; Y10T 292/705; Y10T 292/707;
(Continued)

(56) References Cited

U.S. PATENT DOCUMENTS 839,556 A * 12/1906 Cuff ..... E05B 15/0245 292/341.18
1,094,290 A * 4/1914 Ames ..... E05B 15/0245 292/341.19
(Continued)

FOREIGN PATENT DOCUMENTS

CN 102191890 A * 9/2011 ..... E05B 63/0065
CN 108266106 A * 7/2018 ..... E05B 63/0065
(Continued)

OTHER PUBLICATIONS

"SF-8943 GSS and GMS Cylinder Guard Installation Instructions", SM Surelock McGill, Issue K, Aug. 26, 2020, 4 pages, www.surelockmcgill.com.
(Continued)

*Primary Examiner* — Kristina R Fulton
*Assistant Examiner* — Steven A Tullia
(74) *Attorney, Agent, or Firm* — Gerald E. Helget; Taft Stettinius & Hollister LLP

(57) ABSTRACT

An attack, ballistic and blast resistant door that includes integral concealed mortised four bolt-strike locking assemblies where the bolts are retracted with one hand operation for opening the door and are automatically extended for locking the door with closure of the door. The door has a door frame with four adjustable concealed striker receivers within the door frame. The door has four interconnected concealed mortised bolt lock assemblies, each with a biased bolt, wherein one of the bolt lock assemblies has an engageable brake to hold all four interconnected biased bolts in retraction when the door is opened after a handle interconnected with the four biased blots is moved to a door open position. A roller assembly is provided in the one bolt lock assembly biased to extend and move out from the door when the door is opened and releases the brake and allows the biased bolts to extend and move into the strike receivers when the extended roller assembly is moved inwardly toward the door. A manually adjustable ramp is on a strike plate cover over the strike receiver opposite of the one bolt lock assembly with the engageable brake. The ramp adjustably engages the roller assembly to further move away from or toward the door to adjustably release the brake.

22 Claims, 16 Drawing Sheets

(51) Int. Cl.

| | |
|---|---|
| ***E05C 9/06*** | (2006.01) |
| ***E05B 15/02*** | (2006.01) |
| ***E05B 15/04*** | (2006.01) |
| ***E05B 55/12*** | (2006.01) |
| ***E05B 63/08*** | (2006.01) |
| ***E05B 63/14*** | (2006.01) |
| ***E05B 65/00*** | (2006.01) |
| ***F41H 5/22*** | (2006.01) |
| ***E05C 9/00*** | (2006.01) |
| ***E06B 5/12*** | (2006.01) |
| ***E05B 41/00*** | (2006.01) |

(52) U.S. Cl.

CPC ..... *E05B 55/12* (2013.01); *E05B 63/08* (2013.01); *E05B 63/14* (2013.01); *E05B 65/0075* (2013.01); *E05C 9/002* (2013.01); *E05C 9/041* (2013.01); *E05C 9/06* (2013.01); *F41H 5/226* (2013.01); *E05B 41/00* (2013.01); *E05B 2015/0265* (2013.01); *E05B 2015/0406* (2013.01); *E05B 2063/207* (2013.01); *E06B 5/12* (2013.01)

(58) Field of Classification Search

CPC ..... Y10T 292/0834; Y10T 292/0836; Y10T 292/0846; Y10T 292/307; Y10T 292/096; Y10T 292/1018; E05B 63/202; E05B 15/0255; E05B 15/04; E05B 55/12; E05B 63/08; E05B 63/14; E05B 65/0075; E05B 2015/0265; E05B 2015/0406; E05B 2063/207; E05B 41/00; E05B 15/022; E05B 15/024; E05B 63/0056; E05C 9/002; E05C 9/041; E05C 9/06; E05C 9/00; E05C 9/04; E05C 9/20; E05C 9/021; E05C 9/12; F41H 5/226; E06B 5/12

See application file for complete search history.

(56) References Cited

U.S. PATENT DOCUMENTS

| | | | | | |
|---|---|---|---|---|---|
| 2,535,444 | A * | 12/1950 | Miller | E05B 15/0255 | 292/341.13 |
| 3,161,429 | A * | 12/1964 | Tornoe | E05B 15/025 | 292/341.18 |
| 5,820,177 | A * | 10/1998 | Moon | E05B 63/20 | 292/335 |
| 5,865,479 | A * | 2/1999 | Viney | E05C 9/041 | 70/DIG. 42 |
| 6,283,516 | B1 * | 9/2001 | Viney | E05B 15/004 | 292/160 |
| 7,222,892 | B2 * | 5/2007 | Guidetti | F16B 2/246 | 292/306 |
| 2004/0012210 | A1 * | 1/2004 | Guidetti | F16B 2/246 | 292/303 |
| 2005/0046198 | A1 * | 3/2005 | Alexander | E05B 59/00 | 292/163 |
| 2005/0230195 | A1 * | 10/2005 | Jones | F15B 15/26 | 188/68 |
| 2008/0078216 | A1 * | 4/2008 | Fleming | E05C 9/047 | 70/113 |
| 2010/0327610 | A1 * | 12/2010 | Nakanishi | E05B 63/185 | 292/157 |
| 2014/0125068 | A1 * | 5/2014 | Hagemeyer | E05C 9/041 | 292/138 |
| 2015/0096479 | A1 * | 4/2015 | McCarthy | A47F 9/00 | 89/36.02 |
| 2015/0292841 | A1 * | 10/2015 | Fultz | E06B 3/68 | 89/36.04 |
| 2018/0320414 | A1 * | 11/2018 | Piantek | E05C 1/04 | |
| 2020/0199922 | A1 * | 6/2020 | Cote | E05C 9/22 | |

FOREIGN PATENT DOCUMENTS

| | | | | | |
|---|---|---|---|---|---|
| CN | 109958342 | A * | 7/2019 | A61F 2/78 | |
| EP | 0041913 | A1 * | 6/1981 | E05B 15/0205 | |
| EP | 2821569 | A1 * | 1/2015 | E05B 15/0205 | |
| EP | 2927401 | A1 * | 10/2015 | E05B 63/0004 | |
| FI | 114497 | B * | 5/2003 | E05B 15/004 | |
| FR | 1067271 | A * | 11/1958 | E05B 17/2007 | |
| GB | 2337080 | A * | 11/1999 | E05B 15/004 | |
| KR | 20100013749 | A * | 8/2008 | | |
| WO | WO-0074609 | A1 * | 12/2000 | A61F 2/78 | |
| WO | WO-2015000876 | A1 * | 1/2015 | E05B 15/0205 | |
| WO | WO-2020245558 | A1 * | 12/2020 | E05B 17/2007 | |

OTHER PUBLICATIONS

"High Performance Door Solutions", SM Surelock Mcgill, NASL-017 Oct. 1, 2020, 4 pages, www.surelockmcgill.com.

Detienne, Scott, "ACCESSControl: Blast & Ballistic Door Selection Criteria", Security, May 6, 2006, https://www.securitymagazine.com/articles/78020-accesscontrol-blast-ballistic-door-selection-criteria-1.

* cited by examiner

ATTACK, BALLISTIC AND BLAST RESISTANT SELF-LOCKING DOOR

BACKGROUND OF THE INVENTION

The present invention relates to an attack, ballistic and blast resistant door. More specifically, the invention is an attack, ballistic and blast resistant door that can be made to in-swing or out-swing, all of the door's hardware is mortised concealed, is self-locking and provides the utmost in Department of State (DOS) certified ballistic and forced-entry resistance ((SD-STD-01.01 Revision G (Amended) and SD-STD-01.01 Revision H forced-entry/ballistic resistant threat levels). The door is made of advanced materials and assembly methods that provides highest level of threat protection with clean sight lines and aesthetics. The door provides a wide range of flexibility to create desired features to complement new construction or preserve the aesthetics of existing and historically significant buildings. The self-locking door has simple one-screw adjustability without the need to adjust the door frame and door for being out of plumb, level and square.

Man-made threat resistant doors require an understanding of what are man-made threats. Such threats are defined as human acts that are generated to hurt people and destroy property. These types of threats come from acts of terrorism, criminal acts and civil disturbances. In the case of resistant door assemblies, the attacks are commonly forced entry attacks, ballistic attacks and blast attacks. These type of doors are commonly used by government, military, oil and gas, critical infrastructure, pharmaceutical and commercial concerns.

Door assemblies made to resist these man-made attacks require steel frames that are heavy duty, weighs approximately 1200 pounds, has heavy duty hardware components, made with heavy gauge steel faces or leafs, includes steel core reinforcements and a series of bolt-striker lock sets or combinations around the periphery of the door. Door assemblies of these kinds have codes or ratings. For instance, force entry (FE) attacks are measured in minutes of resistance. Five, fifteen and sixty minutes of protection means the particular door can resist and withstand constant concentrated assaults without the door opening or general component operational failure. Ballistic resistance (BR) standards are derived from UL Laboratories in Levels 2-8: 752-Standard for Safety for Bullet Resisting Equipment Criteria, Table 3.1, Jan. 27, 1995. Such doors are ballistic resistant to 5.56 mm and 7.62 mm rifle rounds. Blast resistance is measured in the door's capability to withstand various magnitudes of blast and associated air pressure threats. The criteria for blast mitigation indicate five categories of building Types A-E was developed by the U.S. General Services Administration (GSA) which can be found GSA Facilities Standard for Public Building Service (PBS-100), Mar. 2003. Fire ratings are offered from 90-180 minutes of UL 10C fire protection. Development of blast-resistant door assemblies requires peak positive blast over-pressure, and specific positive phase impulse. The blast pressure is the maximum positive-phase reflected air blast pressure, measured in pounds per square inch. The blast impulse is the integral of the measured positive phase reflected air blast pressure time history, measured in pounds per inch-milliseconds or "psi-ms." Blast pressure has been tested using static pressure resistance, which is performed by subjecting a door assembly to an ever-increasing pressure load applied over 30 seconds. Currently, most manufacturers use dynamic testing methods, which more closely simulate an actual explosive event.

Hardware selections for man-made threat resistant door assemblies are now typically limited to components offered by the door assembly manufacturers. Utilization of the manufacturer's components is required to achieve door assembly warranties. Their hardware is custom-engineered components, which usually include latching systems with bulky and industrial-looking exposed rods, and even bulkier heavyweight hinges.

The latch point between the door and frame is typically the weakest point of any door assembly, so hardware selection is of particular importance. Typically, multiple latch points include a one-point (door bolt) lock set with two or three additional key-operated dead bolts about 24-inches above and below the lock set. These sets often have exposed reinforcement plates and exposed fasteners For example, integral, concealed, three-point latching systems—where three latches are retracted with tapered bolts—which is the preferred bolt profile to insure continued operation following a threat event causing door movements (See NITA—101 Life Safety Code, 2003 Section 7.2.1.5.9.2).

There is a need for a DOS certified or rated attack, ballistic and blast resistant door that includes integral concealed mortised four-point latching systems where the four latches are retracted with one hand turn operation. The door should have a concealed locking mechanisms with a one-hand mechanical release and automatic four latch locking mechanisms that are simply adjustable to assure smooth release and locking operations.

SUMMARY OF THE INVENTION

An attack, ballistic and blast resistant door that includes integral concealed mortised four bolt-strike locking assemblies where the bolts are retracted with one hand operation for opening the door and are automatically extended for locking the door with closure of the door. The door has a door frame with four adjustable concealed striker receivers within the door frame. The door has four interconnected concealed mortised bolt lock assemblies, each with a biased bolt, wherein one of the bolt lock assemblies has an engageable brake to hold all four interconnected biased bolts in retraction when the door is opened after a handle interconnected with the four biased blots is moved to a door open position. A roller assembly is provided in the one bolt lock assembly biased to extend and move out from the door when the door is opened and releases the brake and allows the biased bolts to extend and move into the strike receivers when the extended roller assembly is moved inwardly toward the door. The bolts are concealed within strike receivers in the door frame when the door is closed. A manually adjustable ramp is on a strike plate cover over the strike receiver opposite of the one bolt lock assembly with the engageable brake. The ramp adjustably engages the roller assembly to further move away from or toward the door to adjustably release the brake to smoothly allow the biased bolts to properly and timely move into the strike receivers to secure and lock the door.

A principle object and advantage of the present invention is that the adjustable strike plate cover, used at the top of the frame or centered at the handle lever mechanism to actuate the roller-brake release mechanism for the 4-point locking assemblies. The ramp is cut on three sides to create an adjustable ramp for the roller. The ramp may be extended or lowered with a single hex screw or bolt to control the release of the bolts on the 4-point locking mechanisms. The ability to adjust the release point prevents the bolts from throwing too early in the closing cycle and preventing the bolts from properly engaging into the armored strike.

Another object and advantage of the present invention is that the 4-point concealed locking mechanisms with a mechanical release which, upon actuation, throws 2 each ⅝"×⅝" machined stainless steel bolts and 2 each ⅝"×1" machined stainless steel bolts into an armored steel strike cover plate and strike plate concealed within the door frame. The armored strike features an adjustable strike receiver concealed beneath a slightly oversized stainless steel strike cover. The slots in the adjustable strike receive allow for +⅛" movement of the strike in or out from its centerline position allowing for optimal adjustment of the strike to the bolts projecting from the door. This adjustment results in reduced play between the projecting bolts and the strikes and is suited for applications such as forced entry resistance, fire door applications and resistance to air blasts and ballistics.

Another object and advantage of the present invention is that the lock mechanisms are conceal mounted inside the cavity of the hollow door to provide multi-point locking security while concealing and protecting the inner workings of the lock mechanisms.

Another object and advantage of the present invention is that the door is attack, ballistic and blast resistant and can be made to in-swing or out-swing, have all of the door's hardware mortised and concealed, is self-locking and provides the utmost in Department of State (DOS) certified ballistic and forced-entry resistance ((SD-STD-01.01 Revision G (Amended) and SD-STD-01.01 Revision H)).

Another object and advantage of the present invention is that the present door has its the lock mechanisms concealed and mounted inside the cavity of the hollow door to provide owners, architects, and engineers with the widest range of flexibility to create the desired features to complement new construction or preserve the aesthetics of existing and historically significant buildings with the highest level of threat protection with clean sightlines and aesthetics.

DETAILED DESCRIPTION

Figure 1:
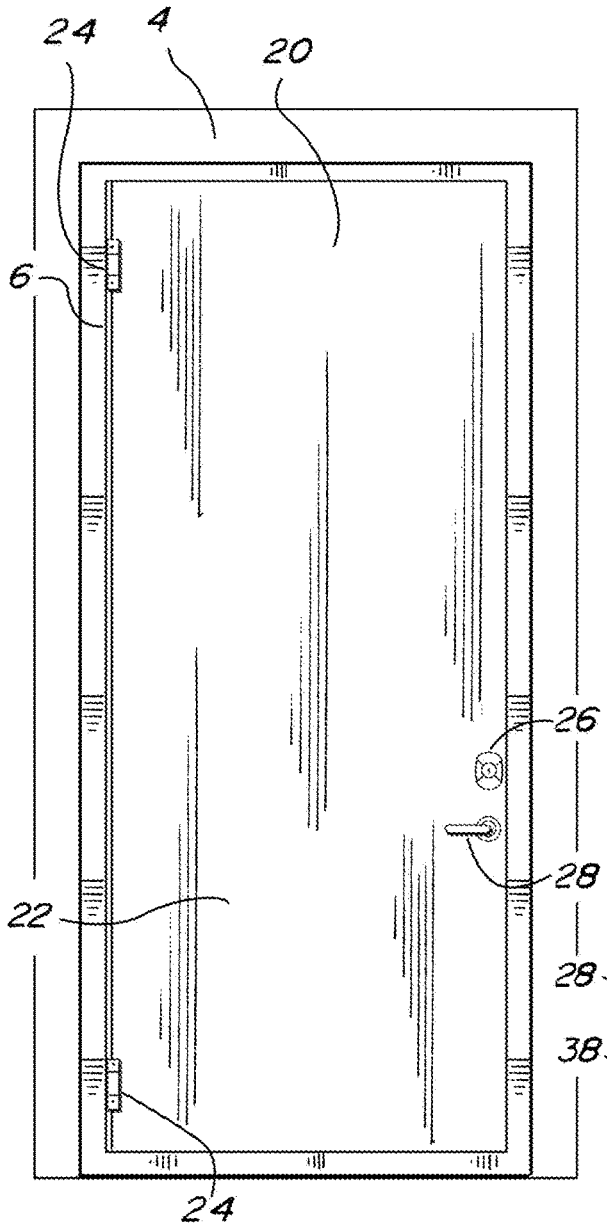
FIG. 1 is a threat outside elevational view of the attack, ballistic and blast resistant door of the present invention.
Figure 2:
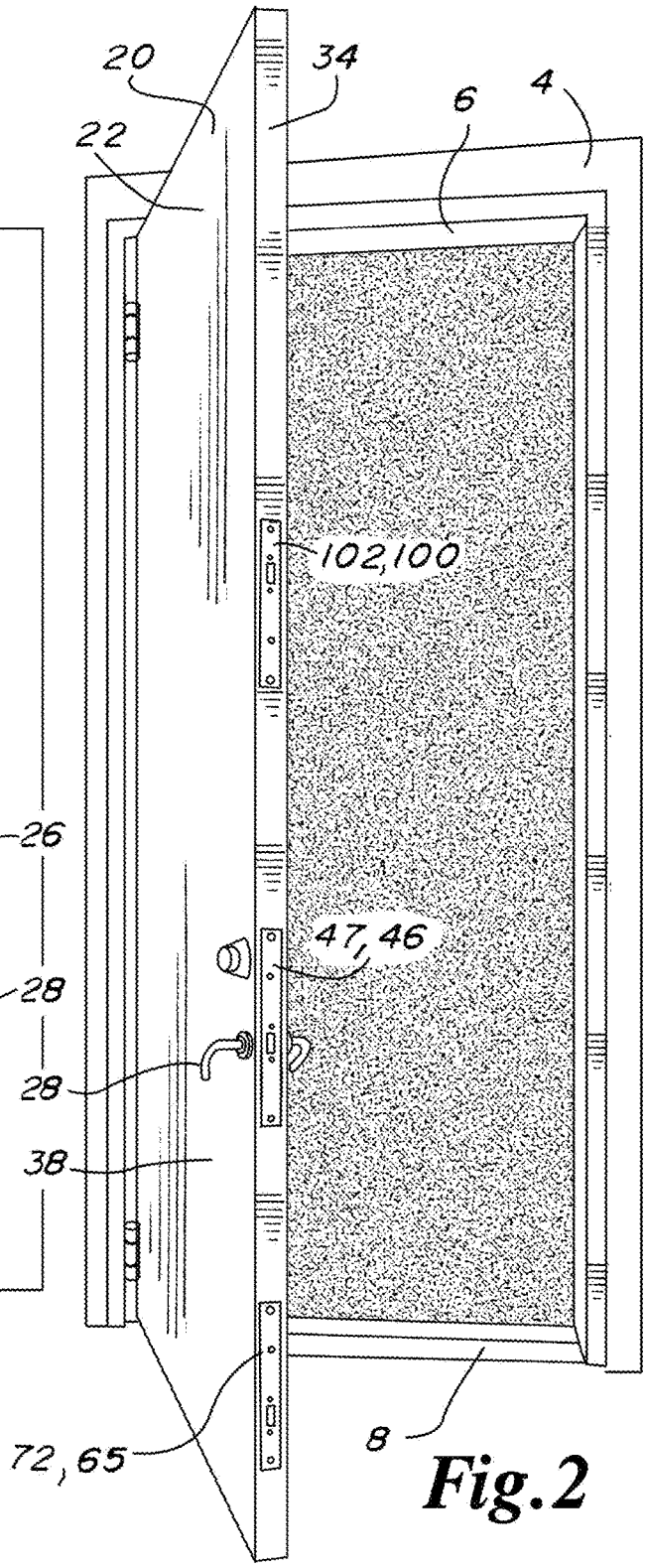
FIG. 2 is a vertical edge elevational view of the attack, ballistic and blast resistant door in open position.
Figure 3:
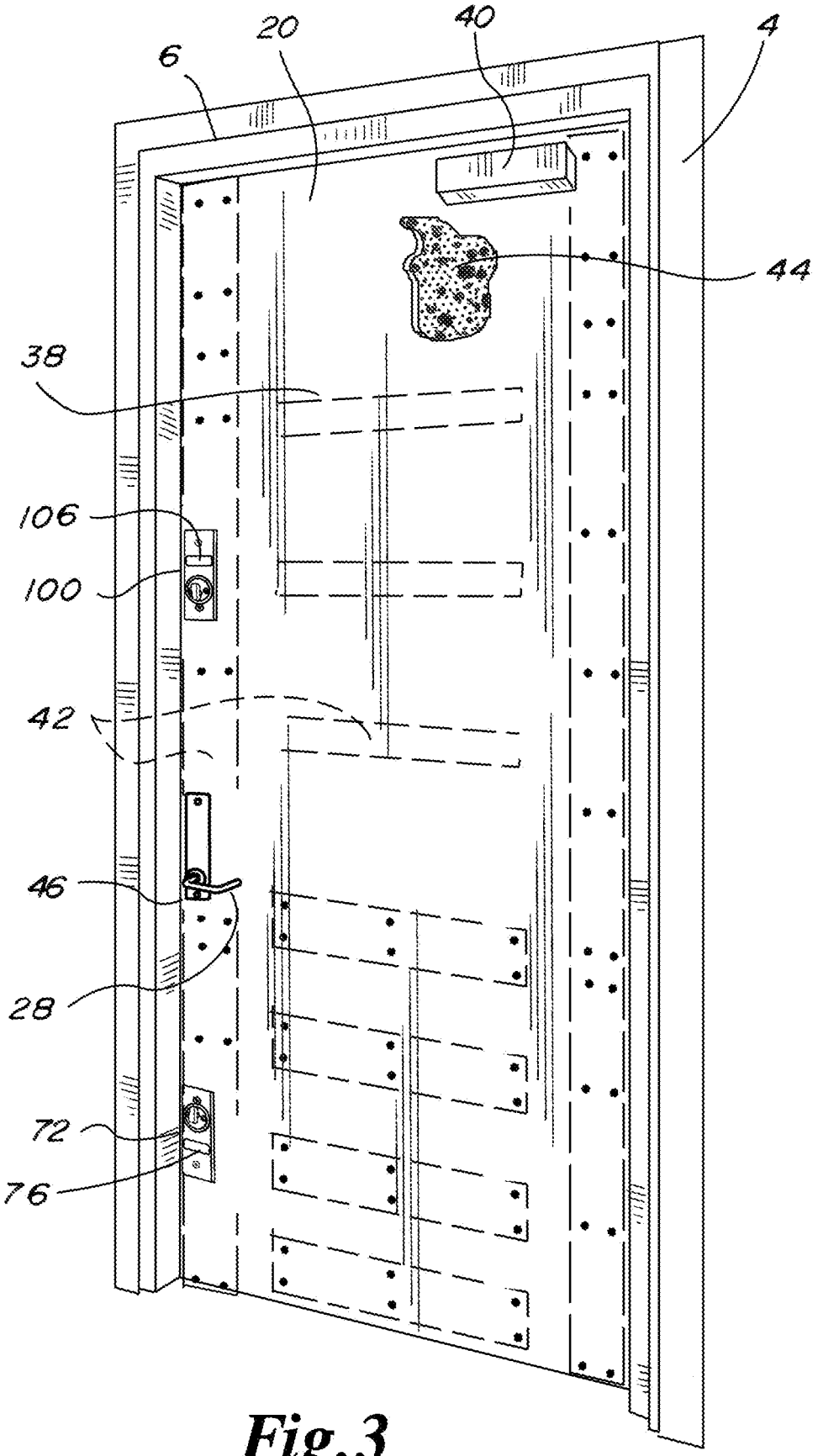
FIG. 3 is a secure inside elevational view of the attack, ballistic and blast resistant door of the present invention.
Figure 4:
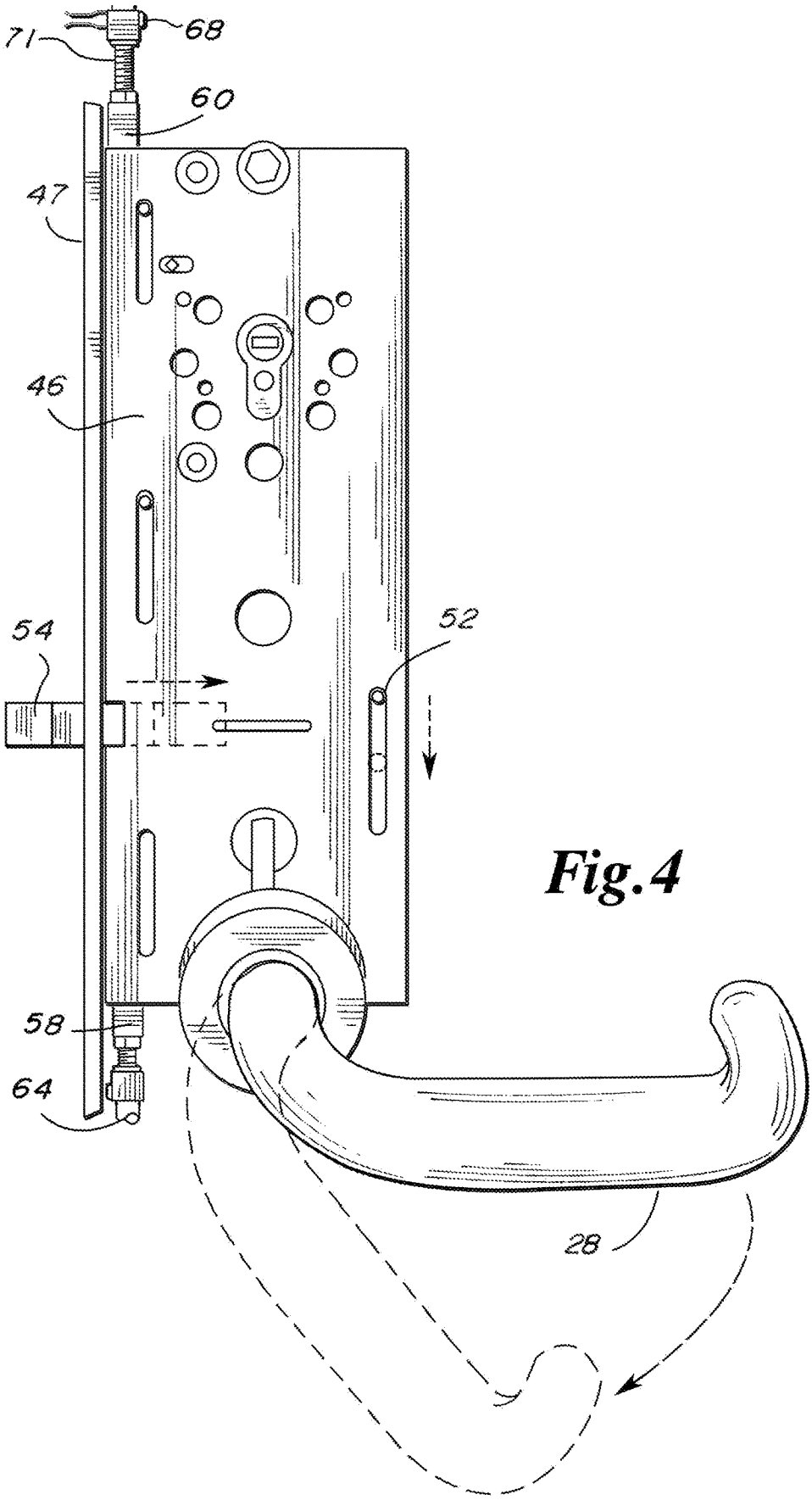
FIG. 4 is a secure inside elevational view of the concealed mortised lever handle center lock assembly.
Figure 5:
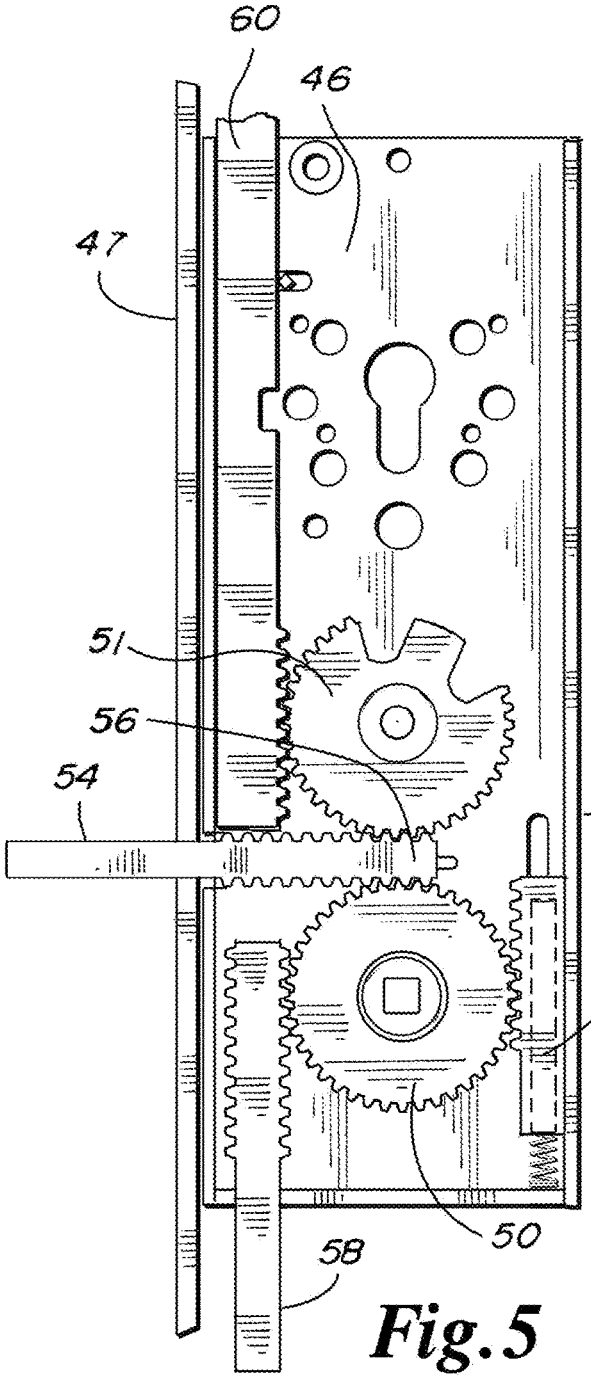
FIG. 5 is a secure inside elevational view of the concealed mortised lever handle lock assembly in secure locked position with the housing partially removed.
Figure 6:
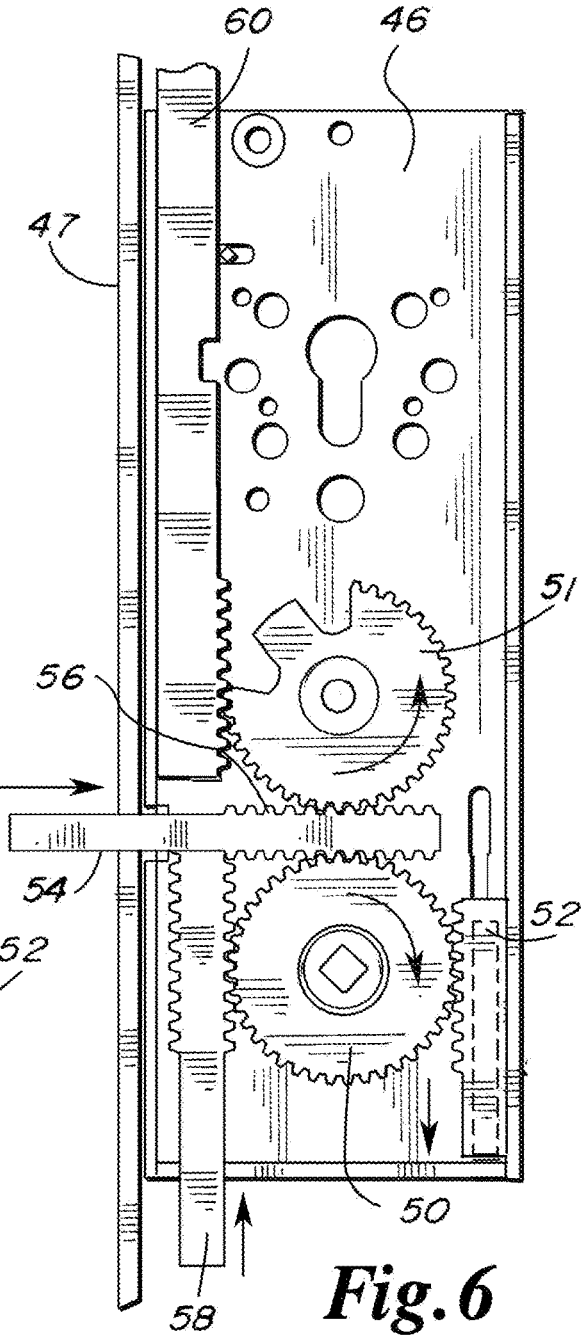
FIG. 6 is a secure inside elevational view of the concealed mortised lever handle lock assembly with the bolt withdrawn from fully locked position with the housing partially removed.
Figure 7:
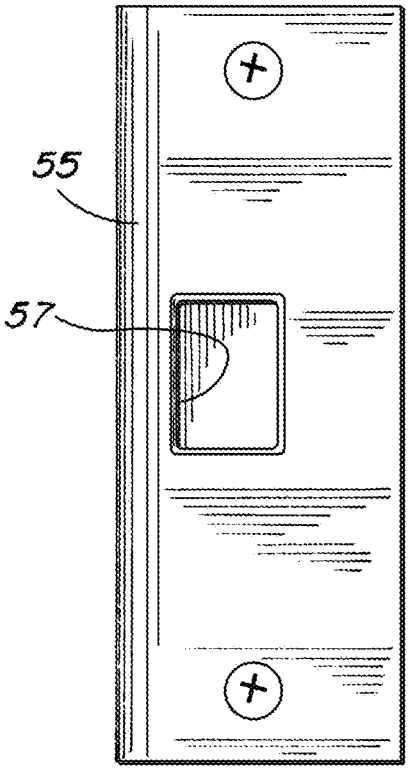
FIG. 7 is an elevational view of the strike steel cover in the door frame of the center lever hand lock assembly.
Figure 8:
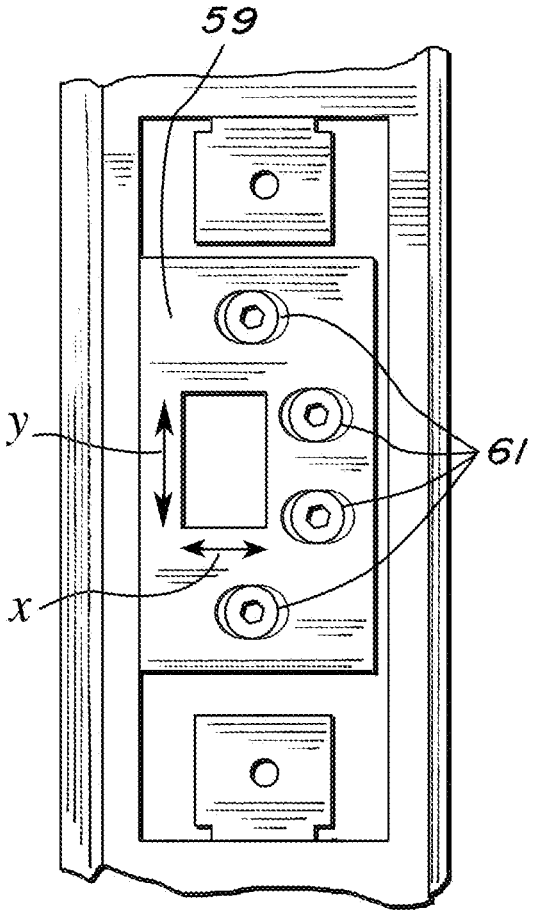
FIG. 8 is an elevational view of the adjustable strike plate of the center lever hand lock assembly.

Referring to FIGS. 1 through 3, the forced attack, ballistic and blast resistant self-locking door 20 has its hardware concealed and mortised within the door 20. The door can be made to in-swing or out-swing. Illustratively, the door is typically 2 ¼ inches thick by 7 to 9 feet tall and 3 ¾ feet wide. The door 20 can weigh up to 1200 pounds.

Surrounding the functioning door 20 is its outermost cementitious embed 4 with head, sill and vertical middle sections. Securely mounted to the embed 4 is the door frame 6 and jamb both of which must be plumbed, leveled and squared. The door frame 6 includes a concealed lever handle center stainless steel strike cover 55, a lower finger interlock lock assembly stainless steel strike cover 92, an upper finger interlock lock assembly stainless steel strike cover 122, and top head bolt lock assembly strike cover 150.

The door has a threat side 22 (usually facing the outside) with minimally exposed butt hinges 24 with ball bearings allowing for easy opening and closing of the heavy door 20. Also on the threat side 22 is a heavy duty key lock 26 and a handle lever 28. Reviewing the lock side vertical edge 34 in FIG. 2, one may see the stainless steel center face plate, 65 lower finger lock stainless steel face plate 73, and the upper finger lock stainless steel face plate 102. The head/top lock stainless steel face plate 134 is at the top of the door 20 discussed below.

Figure 27:
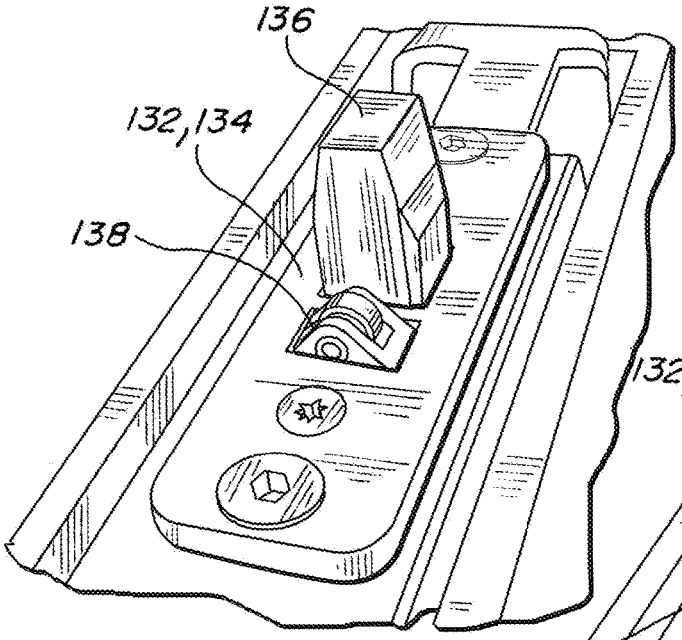
FIG. 27 is a perspective view of the concealed mortised top/head lock assembly with roller assembly with the bolt extended.
Figure 28:
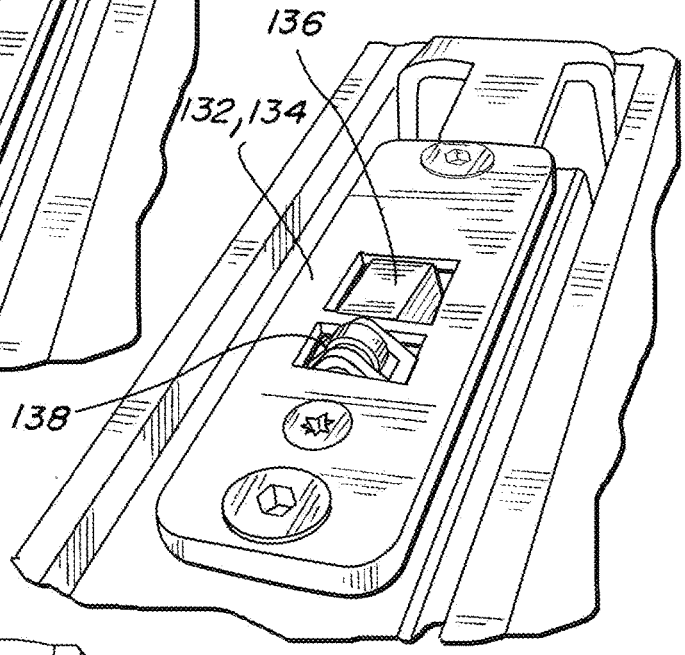
FIG. 28 is a perspective view of the concealed mortised top/head lock assembly with roller assembly with the bolt retracted.
Figure 39:
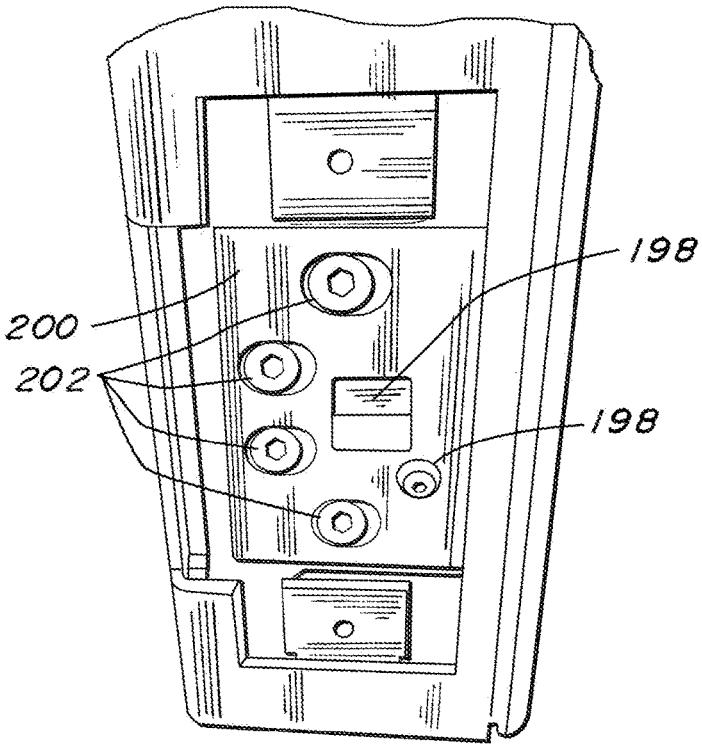
FIG. 39 is an elevational view of the adjustable center strike plate and ramp adjustment screw.
Figure 29:
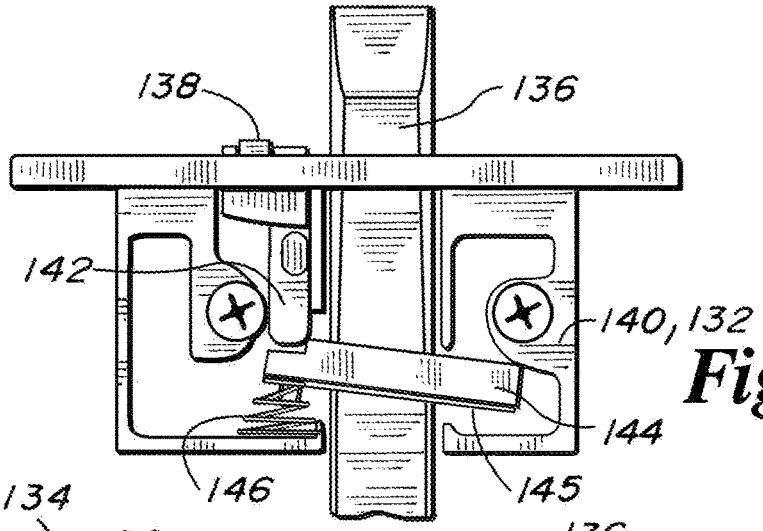
FIG. 29 is an elevational view of the head lock housing assembly with the bolt fully extended and the brake released from a hold on the bolt.
Figure 30:
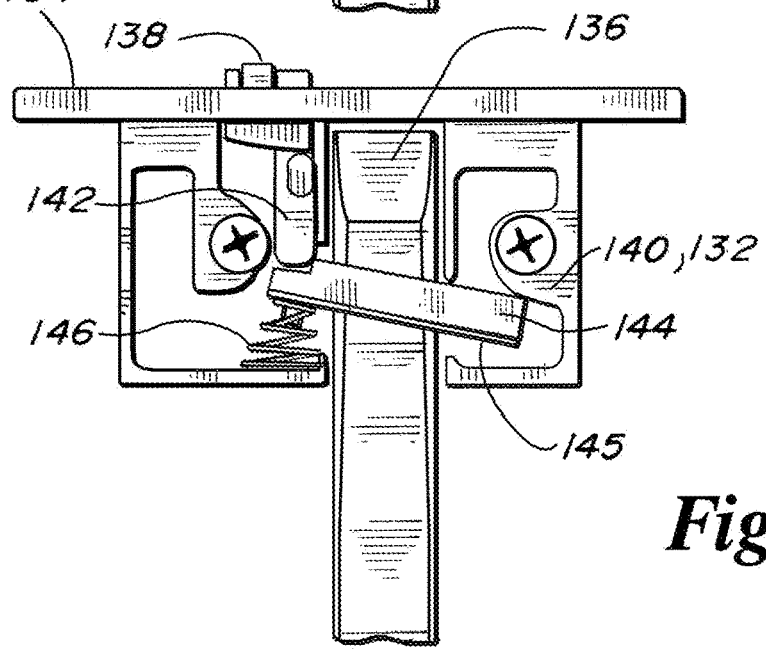
FIG. 30 is an elevational view of the head lock housing assembly with the bolt retracted and held in place by the friction brake surrounding, engaging and biting the bolt which is then kept in retracted position.
Figure 31:
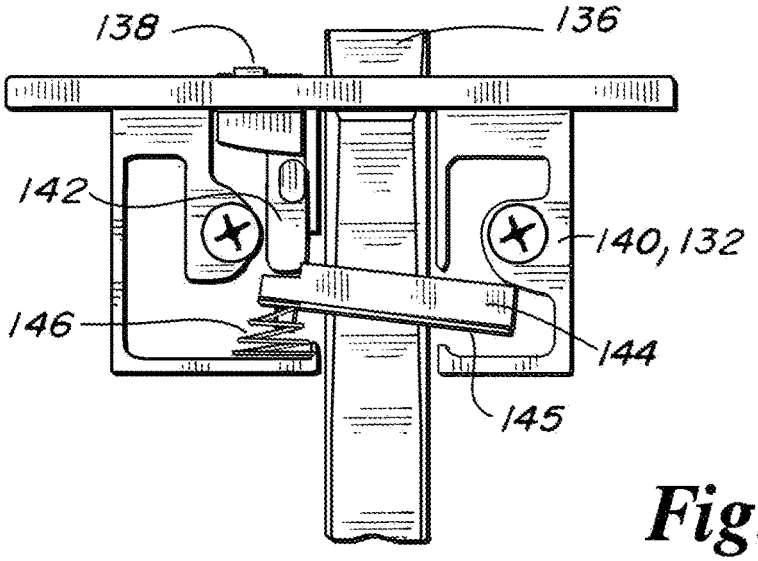
FIG. 31 is an elevational view of the head lock housing assembly with the bolt beginning to extend as the roller assembly is depressed and beginning to release the friction brake engagement of the bolt.

On the secure side 38 of the door 20 are located the concealed mortised lever handle lock assembly 46, the concealed mortised lower finger interlock lock assembly 72 with a shuttle interlock bar status window 76 and the concealed mortised upper finger interlock lock assembly 100 with a shuttle interlock bar status window 106. A door closer 40 is provided to assist with opening and closing of the door 20. FIG. 2 shows the internal beam reinforcements 42 and fire and cold insulation 44 in phantom outlines. The concealed mortised top/head lock assembly 132 with roller and brake sub-assemblies maybe viewed in FIGS. 27-29 discussed in detail below.

Referring to FIGS. 4 through 8, the middle or center horizontal concealed mortised lever hand lock assembly 46 may be seen and understood. This lock assembly 46 has a handle lever 28 for pulling down and lifting up for operation of opening and closing of the door 20. Inside the assembly 46 is a bottom gear 50, an upper gear 51, a spring loaded rack bar 52, a tapered horizontal bolt 54 with a rear track section 56, a vertical lower rack bar 58 and an upper rack bar 60. In this condition the bolt 54 is fully extended (FIG. 5) into the strike receiver 57 of stainless steel center strike plate cover 55 and into the strike plate 59. In operation, the handle lever 48 is pulled downward by an operator's hand. This action rotates the lower or bottom gear 50 clock wise (Arrow in FIG. 6) which lowers (Arrow) spring loaded rack bar 52 into biased spring loaded state (Arrow), lifts the lower rack bar 58 upwardly (Arrow), moves the bolt 54 into retracted unlocked condition, rotates the upper gear 51 counter clock wise which lifts the upper rack bar 60 upwardly. Upon lifting the handle lever to horizontal position, the door 20 is armed for automatic locking when the door 20 is closed into the door frame 6. The strike plate 59 is adjustable along X and Y arrow axes to make sure the bolt 54 always properly aligns with the center strike cover 55, strike receiver 57 and strike plate 59.

Figure 9:
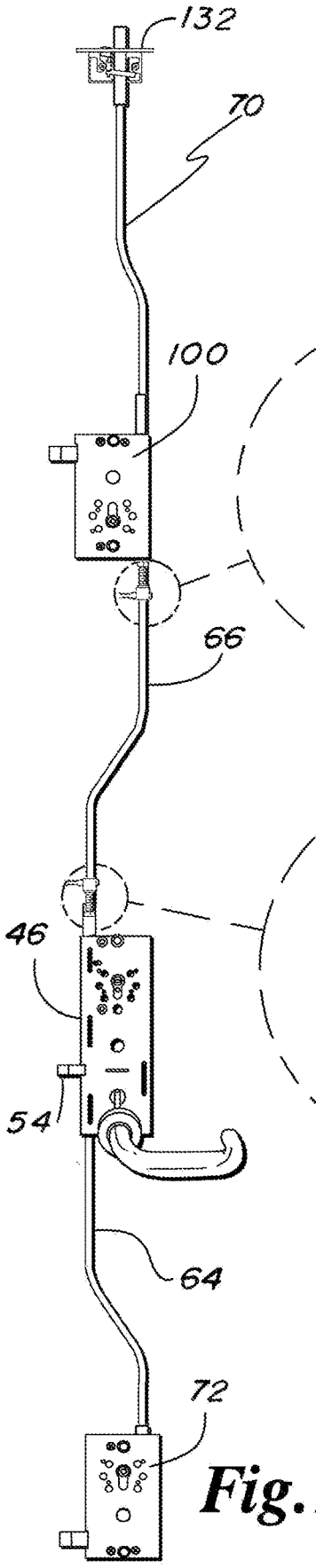
FIG. 9 is an elevational view of the interconnected four lock assemblies in locked position.
Figure 10:
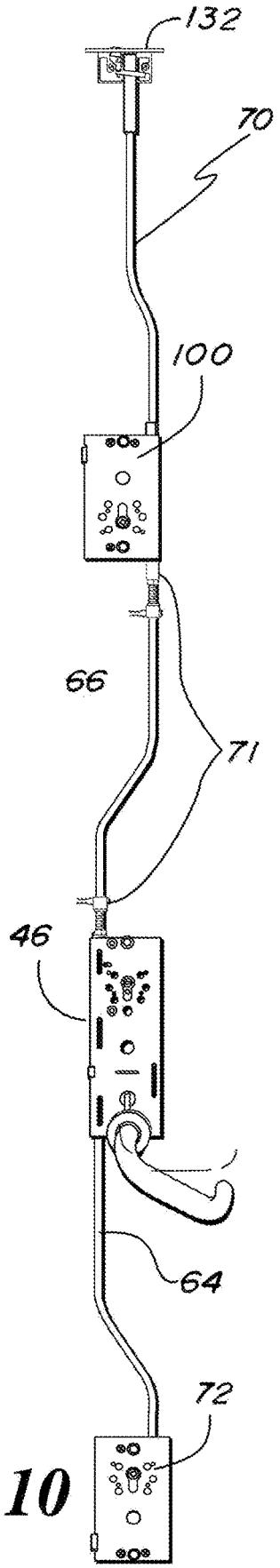
FIG. 10 is an elevational view of the interconnected four lock assemblies in unlocked position.
Figure 11:
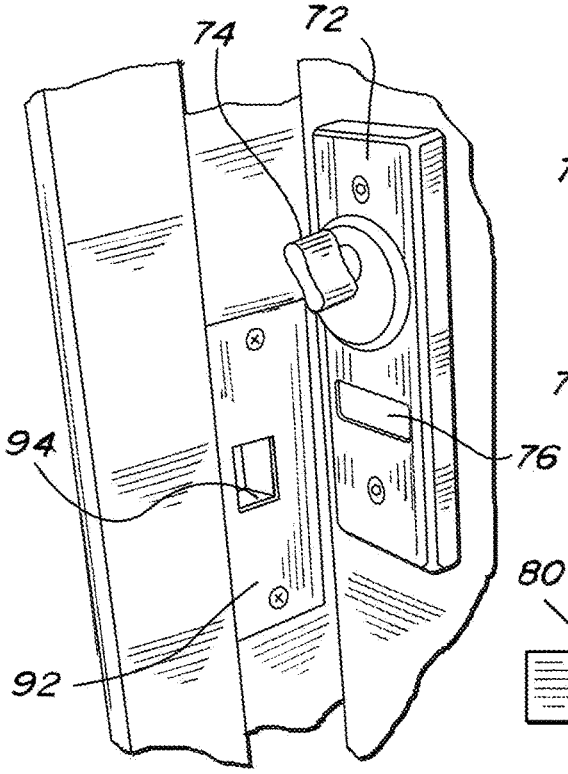
FIG. 11 is a perspective view of the concealed mortised lower lock assembly with the finger interlock and associated steel strike cover.
Figure 12:
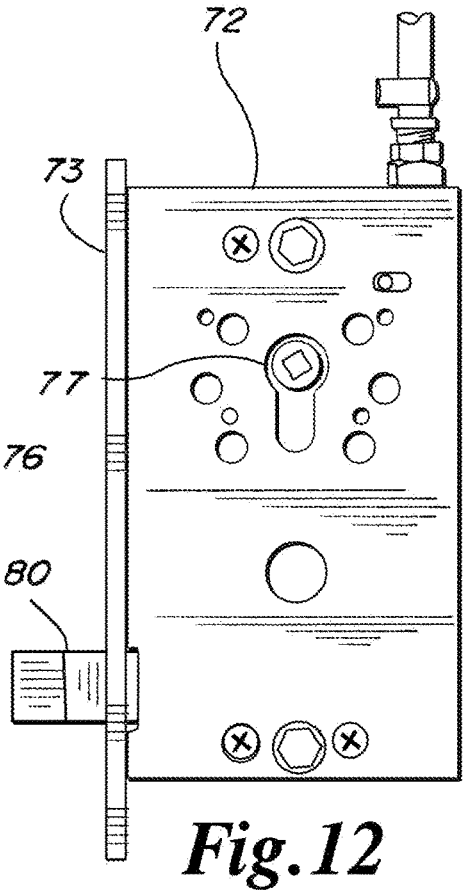
FIG. 12 is a secure inside elevational view of the lower lock assembly with the finger interlock.
Figure 16:
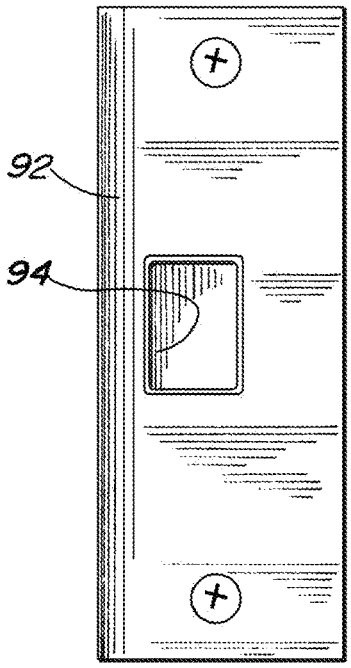
FIG. 16 is an elevational view of the strike steel cover of the lower lock assembly.
Figure 17:
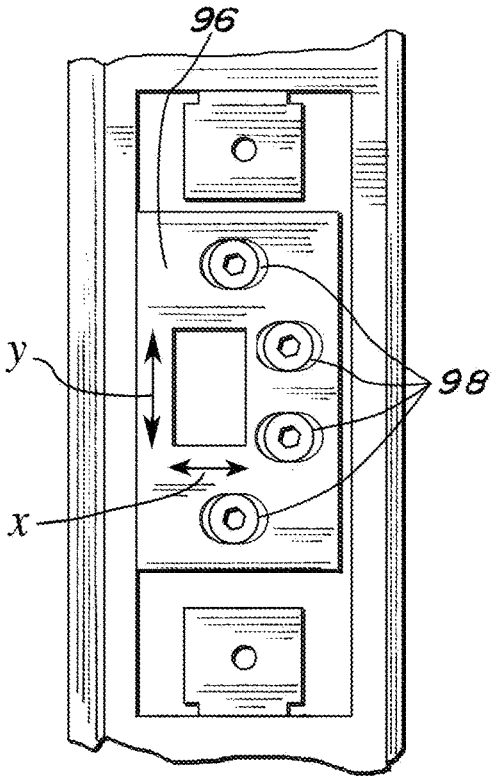
FIG. 17 is an elevational view of the adjustable strike plate of the lower lock assembly.
Figure 13:
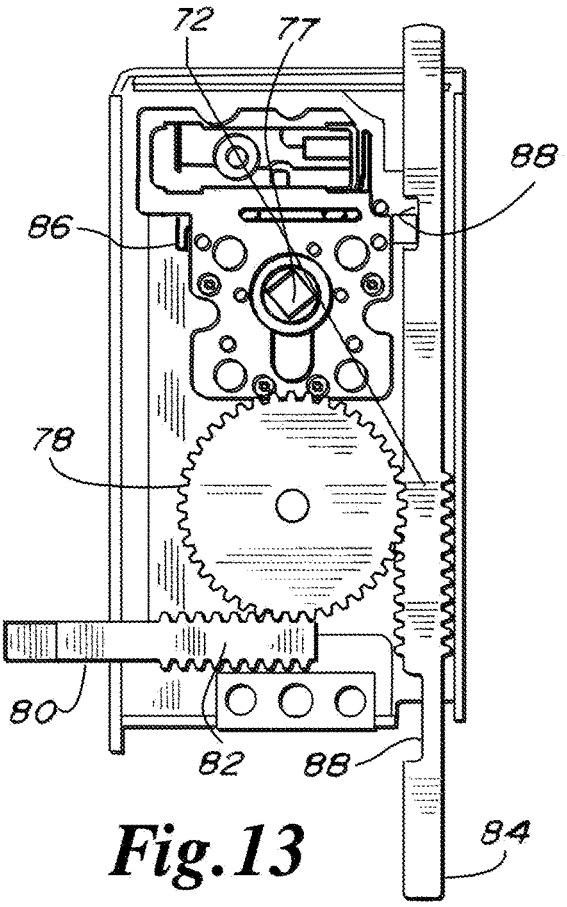
FIG. 13 is a secure inside elevational view of the concealed mortised lower lock assembly with the finger interlock with the bolt both in fully locked position with the housing partially removed.
Figure 14:
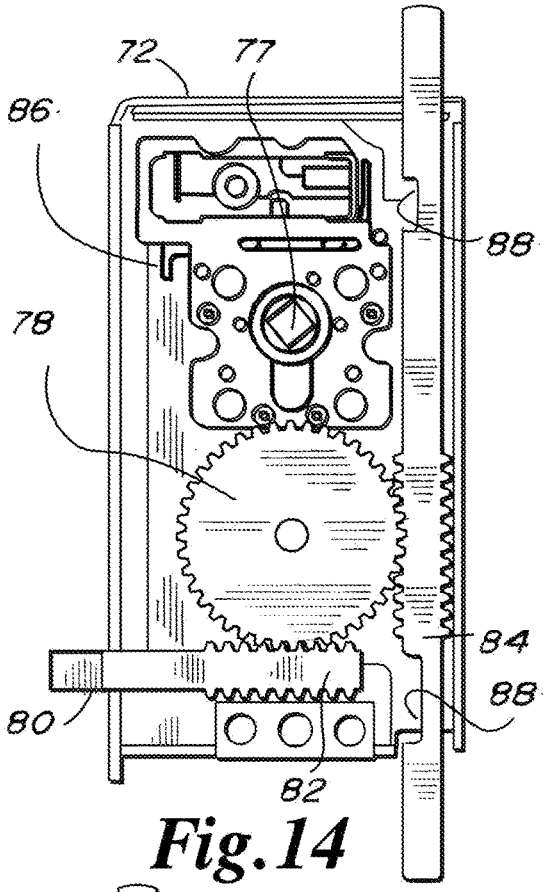
FIG. 14 is a secure inside elevational view of the concealed mortised lower lock assembly with the finger interlock with the bolt partial withdrawn from fully locked position with the housing partially removed.
Figure 15:
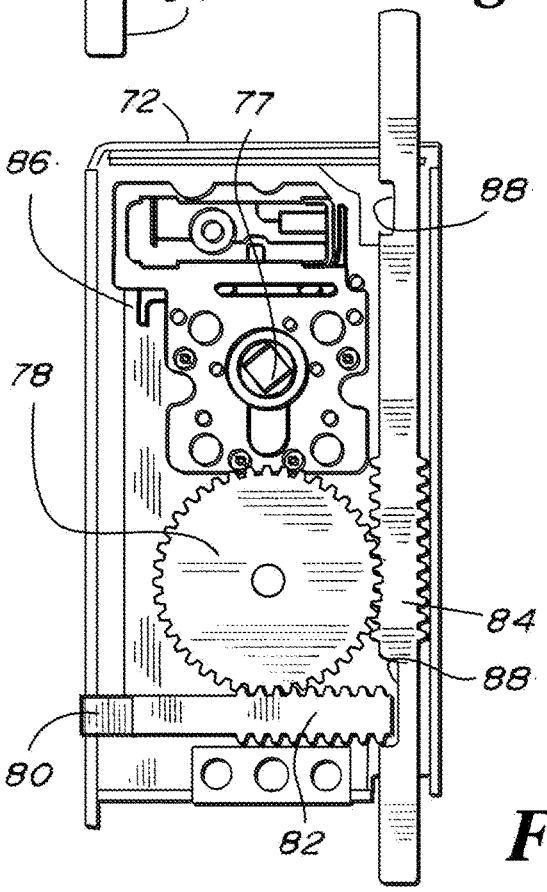
FIG. 15 is a secure inside elevational view of the concealed mortised lower lock assembly with the finger interlock with the bolt both withdrawn from fully locked position with the housing partially removed.
Figure 18:
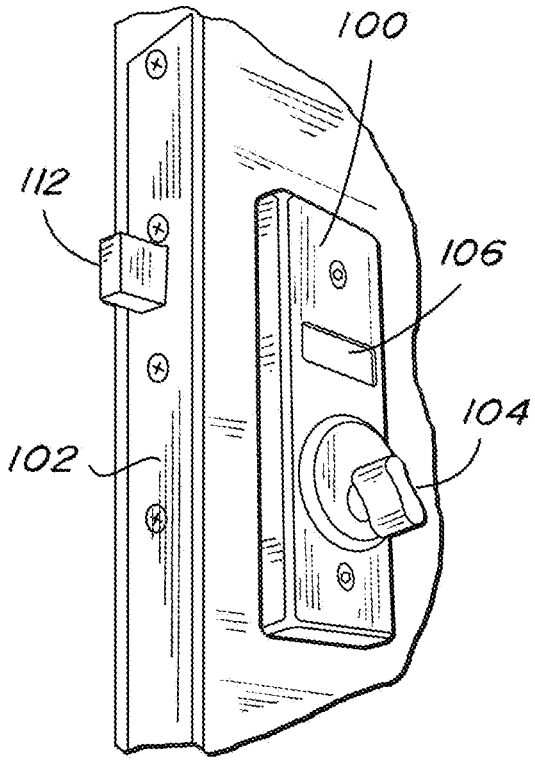
FIG. 18 is a perspective view of the concealed mortised upper lock assembly with the finger interlock.
Figure 19:
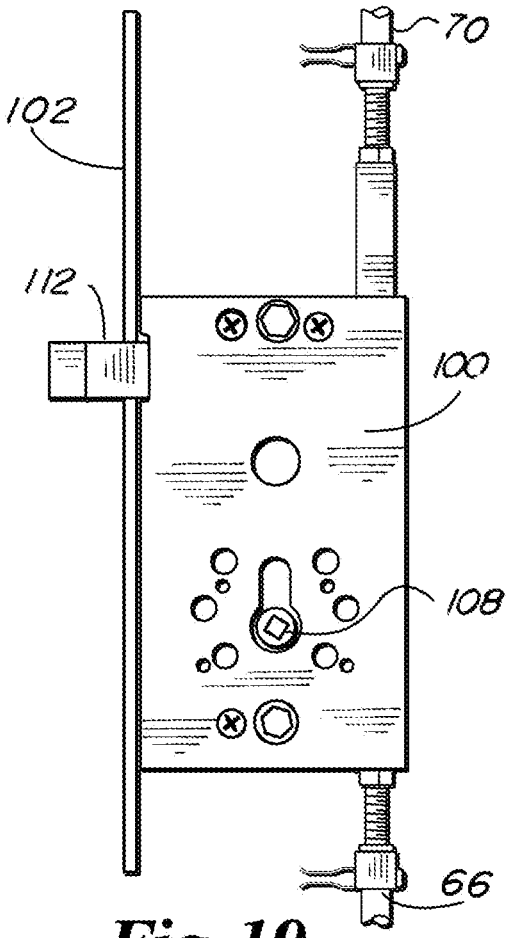
FIG. 19 is a secure inside elevational view of the upper lock assembly with the finger interlock.
Figure 20:
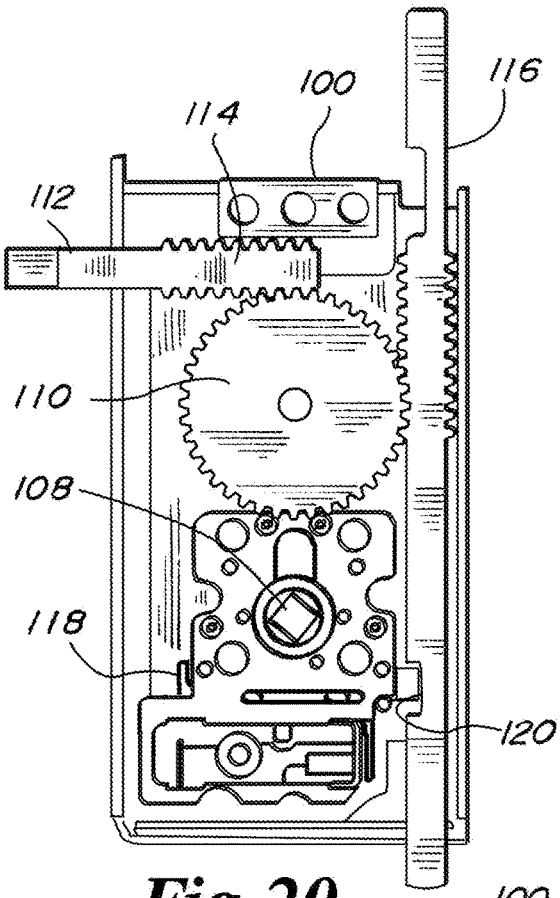
FIG. 20 is a secure inside elevational view of the concealed mortised upper lock assembly with the finger interlock with the bolt both in fully retracted position with the housing partially removed.
Figure 21:
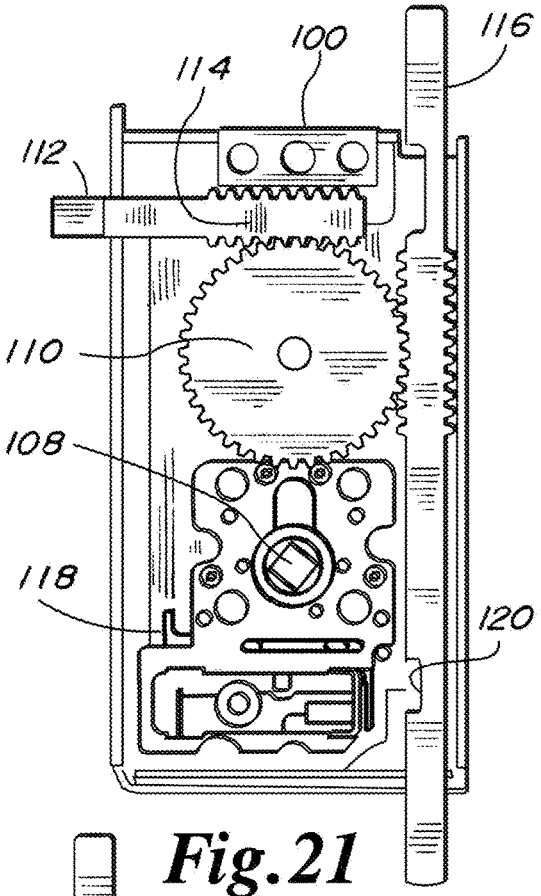
FIG. 21 is a secure inside elevational view of the concealed mortised upper lock assembly with the finger interlock with the bolt partially withdrawn from fully locked position with the housing partially removed.
Figure 22:
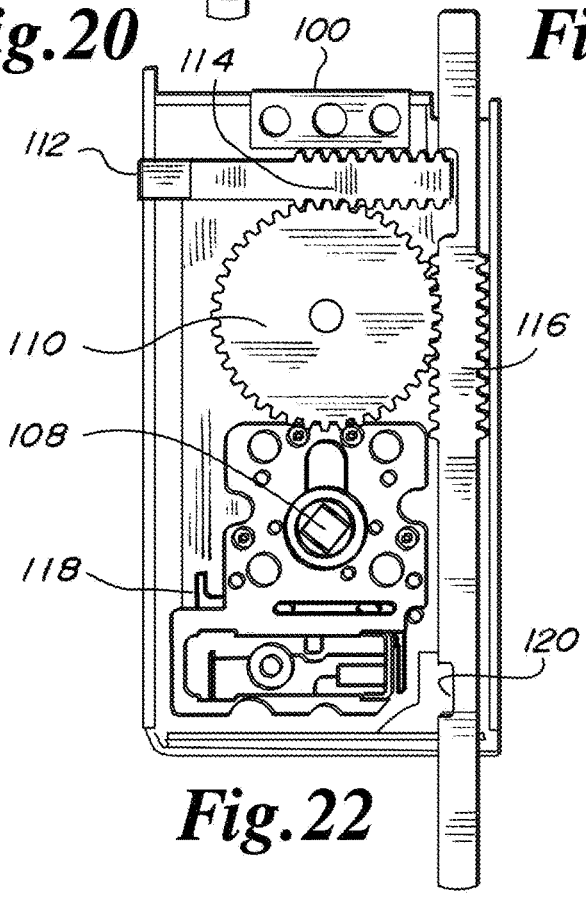
FIG. 22 is a secure inside elevational view of the concealed mortised upper lock assembly with the finger interlock not engaged with the bolt rack cut out.
Figure 23:
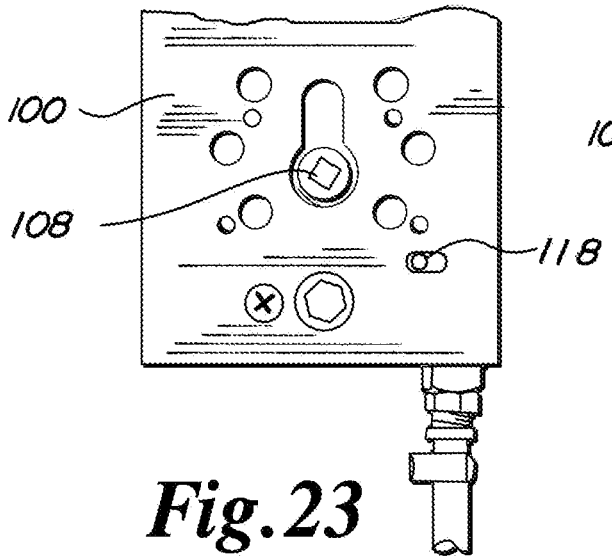
FIG. 23 is a secure inside elevational view of the concealed mortised upper lock assembly with the finger interlock not engaged with the bolt rack cut out.
Figure 24:
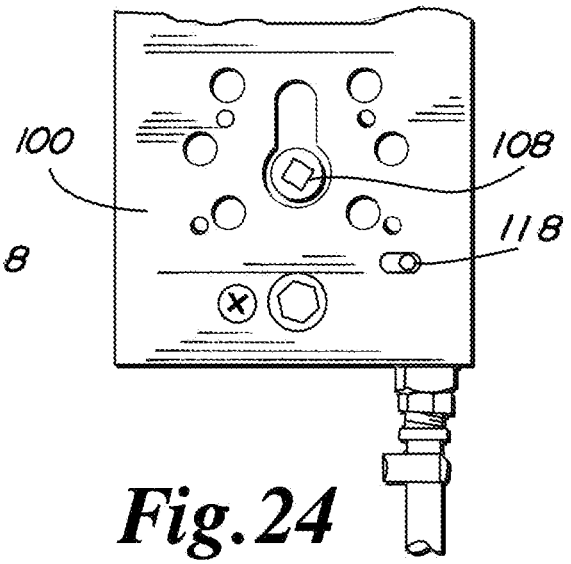
FIG. 24 is a secure inside elevational view of the concealed mortised upper lock assembly with the finger interlock engaged with the bolt rack cut out.
Figure 25:
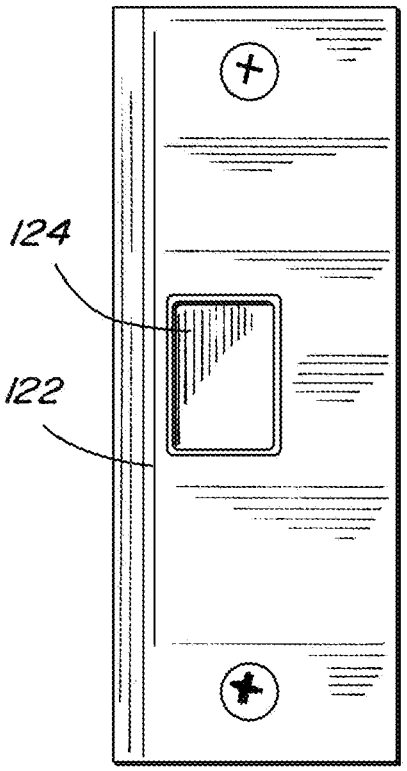
FIG. 25 is an elevational view of the strike steel cover of the upper lock assembly.
Figure 26:
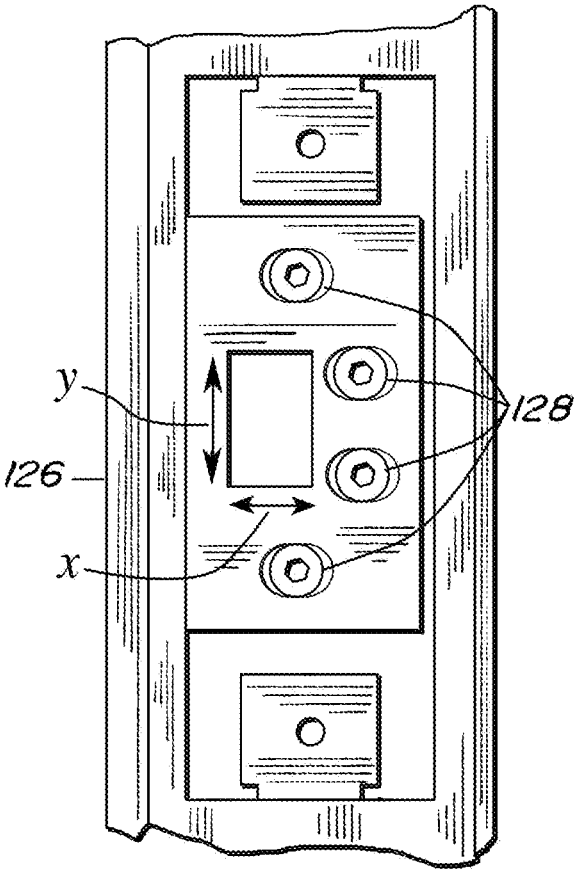
FIG. 26 is an elevational view of the adjustable strike plate of the upper lock assembly.

In FIGS. 9 and 10 the rigid connection of the concealed mortised lever handle lock assembly 46, the concealed mortised lower finger interlock lock assembly 72, the concealed mortised upper finger interlock lock assembly 100 and the concealed mortised top/head lock assembly with roller and brake sub-assembly 132 may be viewed. The assemblies 46. 72, 100 and 132 each have their rack bars 58, 60, 84, 116 and vertical bolt 136 bored with threaded apertures at their ends. Lower adjustable stainless steel tube connector 64, intermediate adjustable stainless steel tube connector 66 and upper adjustable stainless steel tube connector 70 have extending threaded bolts with lock nuts 71, which are threaded into the threaded apertures, and secured rigidly and tightly into place with the nuts 71 once all the connections are properly sized in the door 20.

Referring to FIGS. 11 through 17, the lower horizontal concealed mortised lower interlock assembly 72 has its opposing vertical door edge stainless steel strike plate cover 92. A finger latch 74 with its position indicator window 76 and lower assembly latch receiver 77 are provided on the secure side 38 of the door 20. Inside the assembly 72 housing there is located a gear 78, horizontal tapered bolt 80 with rack section 82 and vertical rack bar 84. When the lock assemblies are in extended bolt locked position, moving the handle lever 28 downwardly moves the vertical rack bar 84 upwardly, rotating the gear 78 counter clockwise pulling the tapered bolt 80 inwardly to retracted position. Thereafter if desired, the shuttle interlock bar 86 may be engaged wherein the shuttle rack bar 86 is moved into the rack bar 84 cut out or receiver 88 by rotation of the finger latch 74 mounted into the latch receiver 77. Thereafter all the lock assemblies 46, 72, 100 and 132 are interlocked into locked position and the handle lever 28 will not open the door 20. A lower stainless steel strike cover 92 with a strike receiver 94 are aligned with lower lock assembly 72. Below the cover 92 is located adjustable strike plate 96 with it four adjustment hex bolts 98 for adjusting the strike plate 96 in the X and Y (arrows) dimensions to smoothly and properly receive the lock bolt 80.

Referring to FIGS. 18 through 26, the upper horizontal concealed mortised interlock assembly 100 has its opposing vertical door edge stainless steel strike plate cover 102. A finger latch 104 with its position indicator window 106 and upper assembly latch receiver 108 are provided on the secure side 38 of the door 20. Inside the assembly 100 housing there is located a gear 110, horizontal tapered bolt bar 112 with rack section 114 and vertical rack bar 116. When the lock assemblies are in extended bolt locked position, moving the handle lever 28 downwardly moves the vertical rack bar 116 downwardly, rotating the gear 110 clockwise pulling the horizontal tapered bolt 112 inwardly to retracted position. Thereafter if desired, the shuttle interlock bar 118 may be engaged wherein the shuttle rack bar 118 is moved into the rack bar 116 cut out or receiver 120 by rotation of the finger latch 104 mounted into the latch receiver 108. Thereafter all the lock assemblies 46, 72, 100 and 132 are interlocked into locked position and the handle lever 28 will not open the door 20. An upper stainless steel strike cover 122 with a strike receiver 124 is aligned with upper lock assembly 100. Below cover 122 is strike plate 126 with its four adjustable hex bolts 128 for adjusting the strike plate 126 in the X and Y (arrows) dimensions to smoothly and properly receive the lock bolt 112.

In FIGS. 27 through 34, the vertical concealed mortised top or head lock and roller assembly 132 may be viewed and understood. The top lock assembly 132 has a top horizontal door edge stainless steel face plate 134, a tapered vertical bolt 136 and an extending biased roller assembly 138 mounted on roller mounting bar 142. Inside the roller and brake assembly housing 140 the roller assembly 138 may be seen supported by a roller mounting bar 142 and a floating brake 144 with accompanying lower sheet metal plate 145 which assists the brake in frictionally gripping and holding the fully retracted vertical bolt 136 when engaged. Brake 144 and plate 145 completely surrounds bolt 136. Below and off to the side of brake 144 is a coiled spring 146 biasing the brake 144 into engagement with the vertical bolt 136 and urging the roller assembly 138 outward from the top of the door 20.

When the tapered vertical bolt 136 is fully extended into locked position within receiver 152 of strike cover 150 and strike receiver 160 of the strike plate 156 with its four adjustable mounting hex bolts 159. along with other bolts 54, 80 and 112, the brake 144 and sheet metal plate 145 are free floating within the housing 140 with spring 146 fully extended. When the lever handle 28 is pulled downwardly by the operator's hand, all the connected bolts 136, 54, 80 and 112 are pulled inwardly to unlocked position which causes the floating brake 144 and sheet metal plate 145 to frictionally grip or bite the vertical bolt 136 and hold it in retracted position. The interconnections with stainless steel tubes 64, 66, 68 and 70 among lever handle lock assembly 46, lower lock assembly 72, upper lock assembly 100 and top lock and roller assembly 132 all assist in this interaction.

When the lever handle 28 is lifted to its upward horizontal position before the door is closed, the brake 144 and sheet metal plate 145 continue to hold all the connected bolts 136, 54, 80 and 112 in locked retracted position. The door 20 is now armed for locking the door 20. When the door 20 is closed into door frame 6, the properly adjusted roller assembly 138 moves inwardly toward the door 20 on ramp 154. As the roller assembly 138 is depressed to push down on the spring 146 to release the brake 144 and sheet metal plate 145 from its grip on the vertical bolt 136. All the connected bolts 136, 54, 80 and 112 in locked retracted position now spring outwardly into their respective strike plates to securely lock the door 20. This action is accomplished under the biased tension of the spring loaded rack bar 52 in the lever handle lock assembly 46 and the gears and rack bars of lock assemblies 46, 72, 100 and 132 move and force all bolts 54, 80, 112 and 136 to fully extend into locked position.

The door 20 will open again when the hand lever 28 is moved downwardly. Alternatively, the operator may engage the shuttle lock bars 86 and 118 into their respective bar cut outs or receivers 88 and 120 which will completely secure the door 20 into a locked condition that will not let the handle lever 28 open the door 20.

If there was a ballistic resistant window in the door, which might be breached by an intruder, the intruder would not be able to open the door 20 by simply moving the handle lever 28 downwardly. Both the shuttle interlock finger latches 74 and 104 must be disengaged before the door 20 will open. The lower shuttle interlock finger latch 74 on its own would be most difficult to reach to disengage through a breached window even if the intruder knew that latch 74 must be disengaged to permit the handle lever 28 to be able to open the door 20.

The smooth operation and alignment of the extended roller assembly 138 is critical to opening and closing operation of the door 20. If the door 20 and frame 6 somehow come out of plumbed, leveled or squared arrangement, the roller assembly 138 may not release the brake 144 and therefore cause the bolts 54, 80, 112 and 136 to not move into extended position thereby not locking the door 20. Additionally, such a condition may cause the roller assembly 138 to release the brake 144 prematurely thereby causing the bolts 54, 80, 112 and 136 to spring into extended position before the door 20 is fully closed thereby disabling the door 20 from any closed condition.

Figure 32:
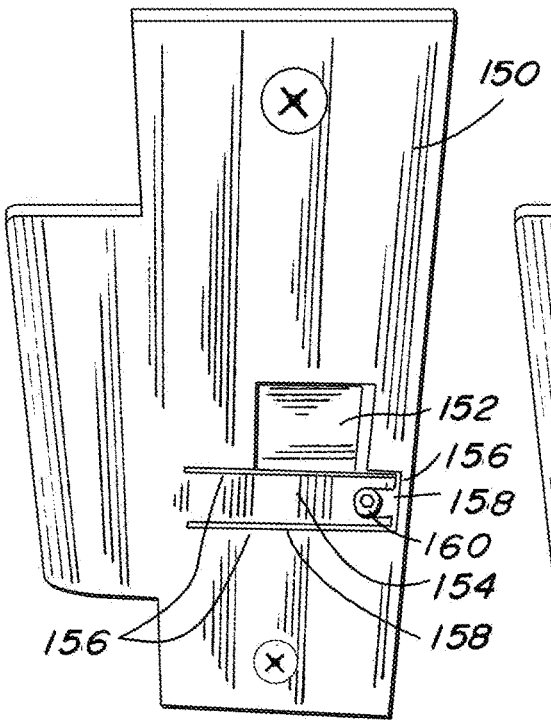
FIG. 32 is an elevational view of the head strike plate cover with the ramp in lowed flat condition.
Figure 33:
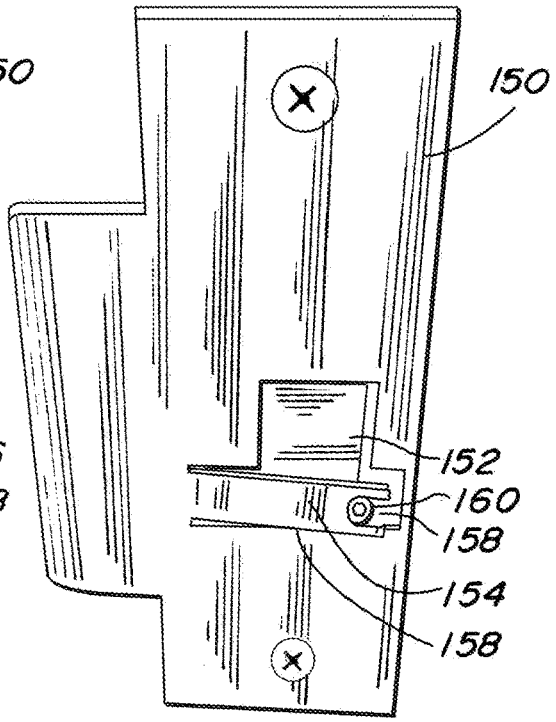
FIG. 33 is an elevational view of the head strike plate cover with the ramp in raised condition.
Figure 34:
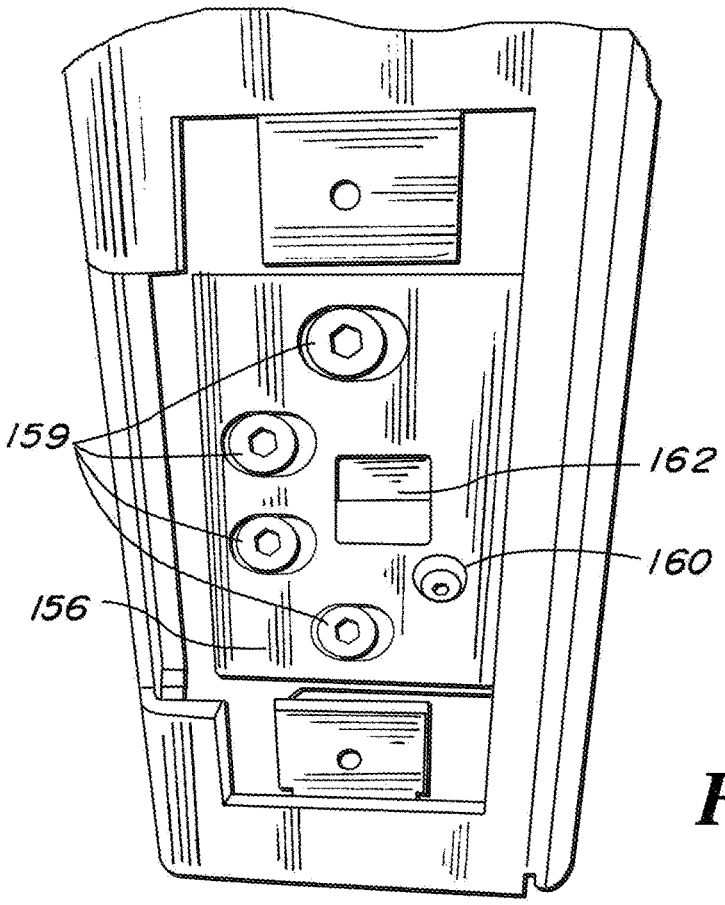
FIG. 34 is the adjustable head strike plate of the head lock assembly.

This problem is solved by the top or head bolt lock and roller assembly stainless steel strike cover plate 150 with its strike receiver 152 and adjustable roller ramp 154. Referring to FIGS. 32 through 34, the adjustable roller ramp 154 is cut out of the strike cover plate 150 on three sides 156. The end of the elevatable ramp 154 facing away from the door 20 has a U-shaped cut out 158 exposing access to an enlarged head hex bolt 160. FIG. 32 shows the ramp generally flush with the cover plate 150 while FIG. 33 shows the ramp raised to urge the roller assembly 138 into the concealed mortised head lock assembly 132 to compensate for the door 20 and frame 6 coming out of alignment. Below the strike plate cover 150 is the strike plate 156 with its four adjustment bolts 158 and the ramp adjusting hex bolt 160 along with its strike receiver 162.

Figure 35A:
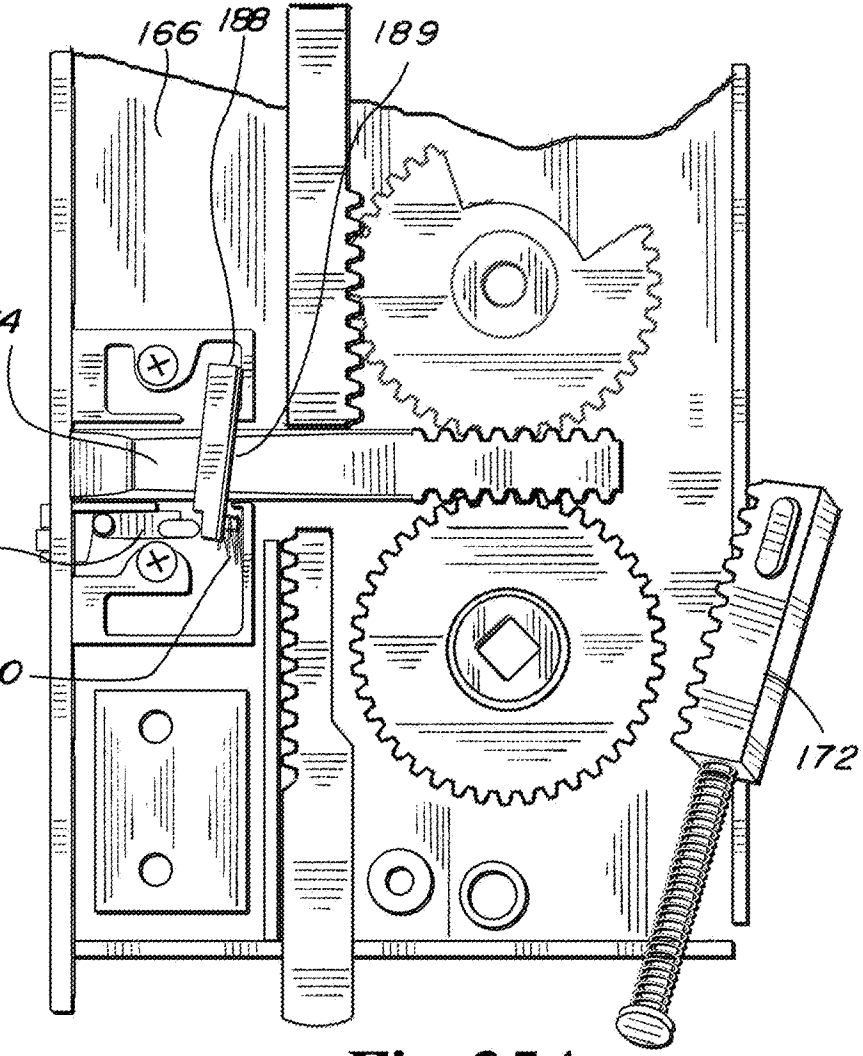
FIG. 35A is an elevational view of a modified center lever lock assembly adapted to include the roller and brake assembly engaged with the extended bolt with spring loaded rack bar removed.
Figure 35:
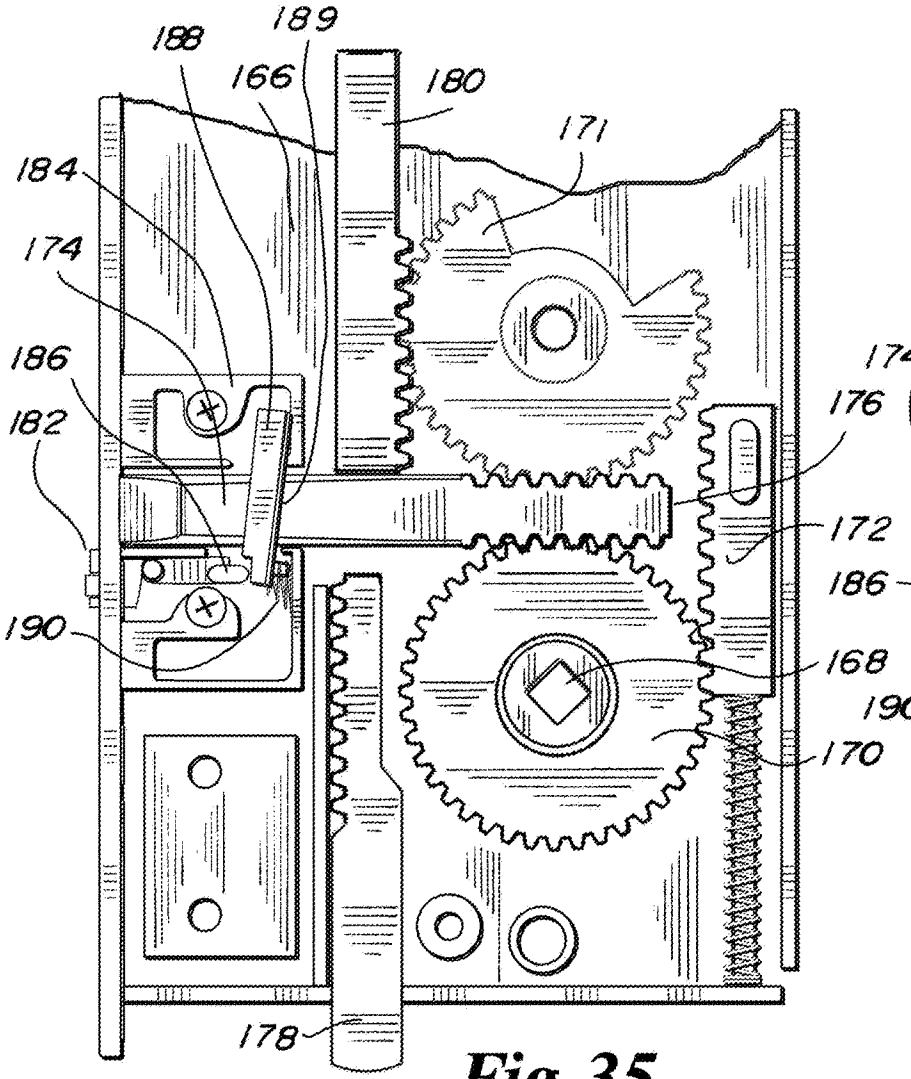
FIG. 35 is an elevational view of a modified center lever lock assembly adapted to include the roller and brake assembly engaged with the retracted bolt.
Figure 36:
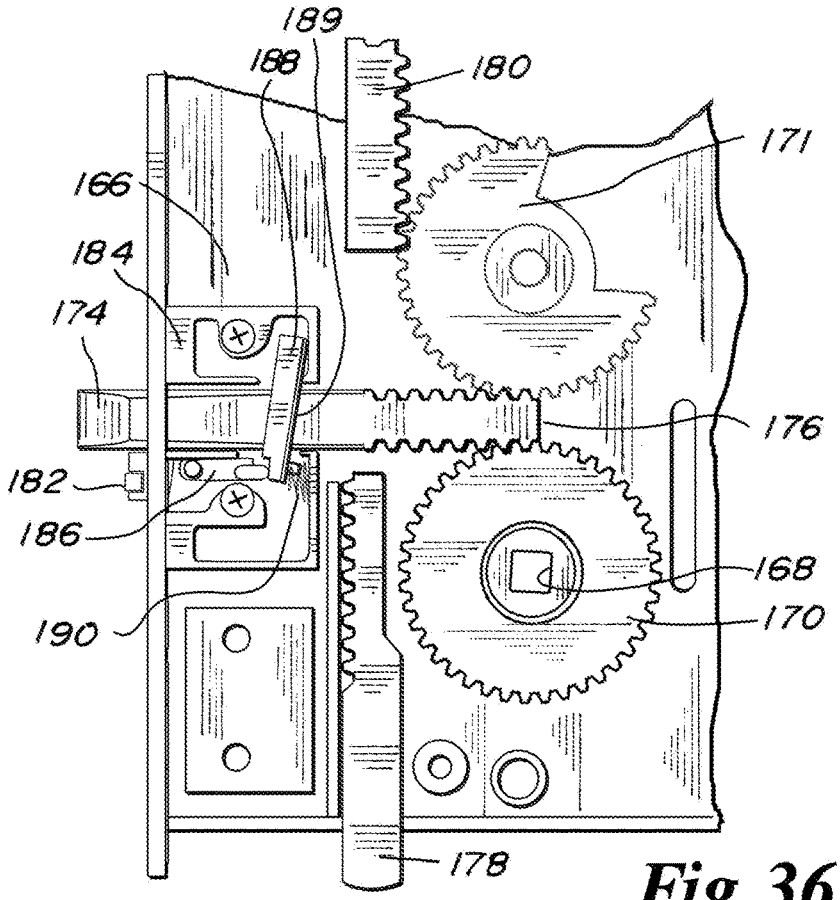
FIG. 36 is an elevationals view of a modified center lever lock assembly adapted to include the roller and brake assembly disengaged with the extended bolt.
Figure 37:
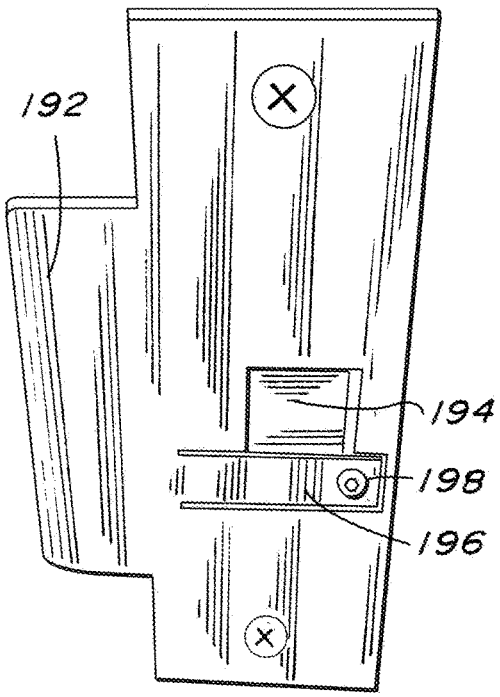
FIG. 37 is an elevational view of the center strike plate cover with the ramp in lowed flat condition.
Figure 38:
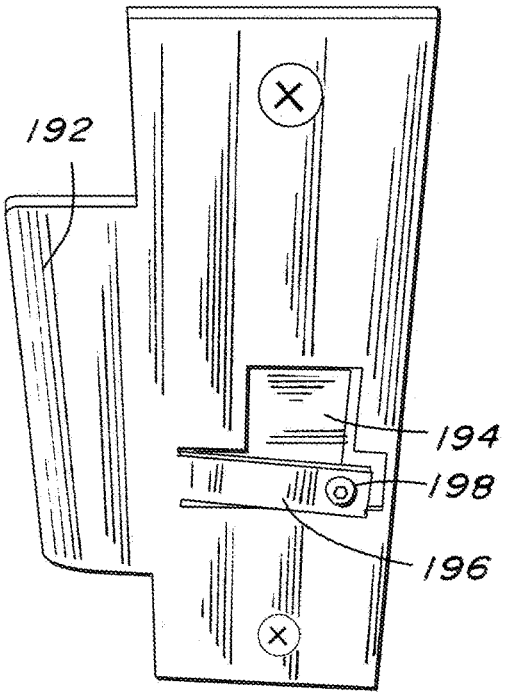
FIG. 38 is an elevational view of the center strike plate cover with the ramp in raised condition.

As seen in FIGS. 35 through 36, an alternative arrangement is shown with a center horizontal concealed mortised lever handle lock with roller and brake assembly 166. With this assembly 166, the roller brake assembly 138 and 144 of the top lock assembly 132 is placed in this horizontal lock assembly 166. This assembly has a lever handle receiver 168, a bottom gear 170, a top gear 171, a spring loaded rack bar 172, a horizontal tapered bolt 174, a bolt rack section 176, and vertical lower and upper rack bars 178 and 180. The extending biased roller assembly 182 is mounted within the roller and brake assembly housing 184. The roller 182 is mounted on a bar 186. The floating brake 188, which engages the bolt 174 in retracted mode, has spring 190 to the right in the drawing urging the roller assembly 182, brake 188 and thin plate 189 to the left into frictional biting and braking engagement with the bolt 174. This lock assembly 166 operates similarly to lever handle lock assembly 46 with the addition of roller and brake assembly 182 and 188 which also operate similarly to top lock and roller assembly 132.

The middle bolt and roller assembly strike cover 192 is similar to head strike cover 150. The strike cover includes a strike receiver 194, an adjustable roller ramp 196 with enlarged head hex bolt 198. In the strike plate 200 behind the cover 192 and also has four adjustment bolts 202 and a strike receiver 198. This arrangement operates similarly to top lock and roller assembly 132 along with strike cover 150.

Additionally, lever handle 28 can be interchanged with a downwardly pivoting long horizontal handle (not shown) being mounted to the door 28 at two pivot points as is well known.

Although specific advantages have been enumerated above, various embodiments may include some, none, or all of the enumerated advantages. Other technical advantages may become readily apparent to one of ordinary skill in the art after review of the following figures and description. It should be understood at the outset that, although exemplary embodiments are illustrated in the figures and described herein, the principles of the present disclosure may be implemented using any number of techniques, whether currently known or not. The present disclosure should in no way be limited to the exemplary implementations and techniques illustrated in the drawings and described herein. Unless otherwise specifically noted, articles depicted in the drawings are not necessarily drawn to scale.

Modifications, additions, or omissions may be made to the systems, apparatuses, and mechanisms described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

The invention claimed is:

1. An attack, ballistic and blast resistant door that is one hand adjustable to assure smooth, opening and locking operations of the door, comprising:

a) a door frame with four adjustable concealed strike receivers within the door frame b) an attack, ballistic and blast resistant door with four interconnected concealed mortised bolt lock assemblies, each with a biased bolt, wherein one of the bolt lock assemblies has an engageable brake to hold all four interconnected biased bolts in retraction after a handle lever interconnected with the four biased blots is moved to a door open position so that the door maybe opened;

c) a roller assembly in the one bolt lock assembly biased to extend and move out from the door, when the door handle lever is moved into a door open position door, the brake holds all four interconnected biased bolts in retraction and the door maybe opened, the bolt lock assemblies are automatically armed when the door handle is moved to closed position, when the door is closed into the door frame the roller assembly depresses into the door and releases the brake and allows the biased bolts to automatically extend and move into the striker receivers and the extended bolts are concealed with in strike receivers in the door frame; and d) a manually adjustable ramp cut out on three sides of a strike plate cover over the strike receiver opposite of the one bolt lock assembly with the engageable brake, the ramp adjustably between a flat condition flush with the strike plate cover and a raised condition out of flat condition when engaging the roller assembly to further move toward the door to adjustably and automatically release the brake smoothly to allow the biased bolts to properly and timely move into the strike receivers to secure and lock the door.

2. The attack, ballistic and blast resistant door of claim 1, wherein the brake is tree floating with a brake subassembly further comprising a cod spring below the roller assembly and brake to urge the roller assembly and brake upwardly to hold the associated retracted bolt and other three connected bolts in retracted position.

3. The attack, ballistic and blast resistant door of claim 1, wherein the brake surrounds one of the tapered bolts with a lower floating sheet metal plate.

4. The attack, ballistic and blast resistant door of claim 1, wherein one of the four interconnected concealed mortised bolt lock assemblies is a centered lever handle lock assembly that includes a spring loaded rack bar that is held in compressed condition and releases when the door is closed and forces the four lock bolts into extension and into the strike receivers thereby automatically locking the door.

5. The attack, ballistic and blast resistant door of claim wherein a second of the four interconnected concealed mortised bolt lock assemblies comprises a manual interlock assembly with an auxiliary lock assembly that overridingly holds the four bolts in secured locked condition.

6. An attack, ballistic and blast resistant door that is one hand adjustable to assure smooth opening and locking operations of the door and is automatically armed to lock the door when the door is closed, comprising:

a) door frame with four adjustable concealed strike receivers within the door frame;

b) an attack, ballistic and blast resistant door with four interconnected concealed mortised bolt lock assemblies, each with a biased bolt, wherein one of the bolt lock assemblies has an engageable brake to hold all four interconnected biased bolts in retraction when the door is opened after a handle lever interconnected with the four biased bolts is moved to a door open position afterwhich the handle lever is moved to an automatically armed locked position;

c) a roller assembly in the one bolt lock assembly biased to extend and move out from the door when the door is opened, the handle lever is then moved to automatic locked position, when the door is moved to closed and locked position within the door frame, the roller assembly moves toward the door to automatically release the brake smoothly to allow the biased bolts to properly and timely move into the strike receivers to secure and lock the door, the bolts being concealed with in strike receivers in the door frame when the door is closed; and d) a manually adjustable ramp cut out of a strike plate cover on three sides over the strike receiver opposite of the one bolt lock assembly with the engageable brake, when the ramp adjustably engages the roller assembly upon closing of the door and further moves the roller assembly into the door to automatically release the brake to smoothly to allow the biased bolts to properly and timely move into the strike receivers to secure and lock the door.

7. The attack, ballistic and blast resistant door of claim 6, wherein the ramp is cut out of the strike plate cover on three sides and is generally flush with the strike plate cover when not adjusted.

8. The attack, ballistic and blast resistant door of claim 7, further comprising a free floating end of the ramp facing away from the door having a U-shaped cut out exposing access to an enlarged head hex bolt which will liar the ramp outwardly from the strike cover with outward turning of the hex bolt.

9. The attack, ballistic and blast resistant door of claim 6, further comprising three additional strike plate covers for the other three strike plates.

10. The attack, ballistic and blast resistant door of claim 6, wherein the brake is free floating within a brake subassembly further comprising a coil spring below the roller assembly and brake to urge the roller assembly and brake upwardly to engaged and hold the retracted bolt of the one bolt lock assembly and other three interconnected bolts in retracted position.

11. The attack, ballistic and blast resistant door of claim 6, wherein the brake surrounds the tapered bolt of the one bolt lock assembly with a lower floating sheet metal plate.

12. The attack, ballistic and blast resistant door of claim 6, wherein one of the four interconnected concealed mortised bolt lock assemblies is a centered lever handle lock assembly that includes a spring loaded rack bar that is held in compressed condition and releases when the door is closed and forces the four lock bolts into extension and into the strike receivers thereby automatically locking the door.

13. An attack, ballistic and blast resistant door that is one hand adjustable to assure smooth opening and locking operation of the door and is automatically armed to lock the door when the door is closed, comprising:

a) a door frame with four adjustable concealed strike receivers within the door frame;

b) an attack, ballistic and blast resistant door with four interconnected concealed mortised bolt lock assemblies, each with a biased bolt, wherein one of the bolt lock assemblies has an engageable free floating brake surrounds the one biased bolt to hold all four interconnected biased bolts in retraction when the door is opened after a handle lever interconnected with the four biased blots is moved to a door open position afterwhich the handle lever is moved to an automatically armed locked position;

c) a roller assembly in the one bolt lock assembly biased to extend and move out from the door when the door is opened, the handle lever is then moved to automatic locked position, when the door is moved to closed and locked position within the door frame, the roller assembly moves toward the door to automatically release the brake to allow the biased bolts to properly and timely move into the strike receivers to secure and lock the door, the bolts being concealed with in strike receivers in the door frame when the door is closed; and d) a manually adjustable ramp cut out of a strike plate cover on three sides over the strike receiver opposite of the one bolt lock assembly with the engageable brake, when the ramp adjustably engages the roller assembly to further move the roller assembly into the door as the door is closed to automatically release the brake to allow the biased bolts to properly and timely move into the strike receivers to secure and lock the door.

14. The attack, ballistic and blast resistant door of claim 13, further comprising a free floating end of the ramp facing away from the door having a U-shaped cut out exposing access to an enlarged head hex bolt which will lift the ramp outwardly from the strike cover with outward turning of the hex bolt.

15. The attack, ballistic and blast resistant door of claim further comprising three additional strike plate covers for the other three strike plates.

16. The attack, ballistic and blast resistant door of claim 13, wherein the brake is free floating within a brake subassembly further comprising a coil spring below the roller assembly and brake to urge the roller assembly and brake upwardly to engaged and hold the retracted four bolts in retracted position.

17. The attack, ballistic and blast resistant door of claim 13, wherein the brake has a lower floating sheet metal plate.

18. The attack, ballistic and blast resistant door of claim 13, wherein one of the four interconnected concealed mortised bolt lock assemblies is a centered lever handle lock assembly that includes a spring loaded rack bar that is held in compressed condition and releases when the door is closed and forces the four lock bolts into extension and into the strike receivers thereby automatically locking the door.

19. The attack, ballistic and blast resistant door of claim 13, wherein a second of the four interconnected concealed mortised bolt lock assemblies comprises a manual interlock assembly with an auxiliary lock assembly that overridingly holds the four bolts in secured locked condition.

20. An attack, ballistic and blast resistant door that is one hand adjustable to assure smooth opening and locking operations of the door and is automatically armed to lock the door when the door is closed, comprising:

a) a door frame with four adjustable concealed strike recievers within the door frame;

b) an attack, ballistic and blast resistant door with four interconnected concealed mortised bolt lock assemblies, each with a biased bolt, wherein one of the bolt lock assemblies has an engageable free floating brake surrounds the one biased bolt to hold all four interconnected biased bolts in retraction when the door is opened after a handle lever interconnected with the four biased blots is moved to a door open position afterwhich the handle lever is moved to an automatically armed locked position;

c) a roller assembly in the one bolt lock assembly biased to extend and move out from the door when the door is opened, the handle lever is then moved to automatic locked position, when the door is moved to closed and locked position within the door frame, the roller assembly moves toward the door to automatically release the brake to allow the biased bolts to properly and timely move into the strike receivers to secure and lock the door, the bolts being concealed with in strike receivers in the door frame when the door is closed; and d) a manually adjustable ramp cut out of a strike plate cover over the strike receiver opposite of the one bolt lock assembly with the engageable brake wherein the ramp is cut out on three sides with a free floating end of the ramp facing away from the door having a U-shaped cut out exposing access to an enlarged head hex bolt which will lift the ramp outwardly from the strike cover with outward turning of the hex bolt, when the ramp adjustably engages the roller assembly to further move the roller assembly into the door as the, door is closed to automatically release the brake to allow the biased bolts to properly and timely move into the strike receivers to secure and lock the door.

21. An attack, ballistic and blast resistant door that is one hand adjustable to assure smooth opening and locking operations of the door, comprising:

a) a door frame with four adjustable concealed strike receivers within the door frame;

b) an attack, ballistic and blast resistant door with four interconnected concealed mortised bolt lock assemblies, each with a biased bolt, wherein one of the bolt lock assemblies has an engageable brake to hold all four interconnected biased bolts in retraction after a handle lever interconnected with the four biased blots is moved to a door open position so that the door maybe opened;

c) a roller assembly in the one bolt lock assembly biased to extend and move out from the door, when the door handle lever is moved into a door open position door, the brake holds all four interconnected biased bolts in retraction and the door maybe opened, the bolt lock assemblies are automatically armed when the door handle is moved to closed position, when the door is closed into the door frame the roller assembly depresses into the door and releases the brake and allows the biased bolts to automatically extend and move into the striker receivers and the extended bolts are concealed with in strike receivers in the door frame; and d) a manually adjustable ramp on a strike plate cover over the strike receiver opposite of the one bolt lock assembly with the engageable brake, the ramp having a U-sharped cut out having a free floating end facing away from the door exposing access to an enlarged head hex bolt which will lift the ramp outwardly from the strike cover with outward turning of the hex bolt, whereby the ramp being adjustable between a flat condition flush with the strike plate cover and a raised condition out of flat condition when engaging the roller assembly to further move toward the door to adjustably and automatically release the brake smoothly to allow the biased bolts to properly and timely move into the strike receivers to secure and lock the door.

22. An attack, ballistic and blast resistant door that is one hand adjustable to assure smooth opening and locking operations of the door, comprising:

a) a door frame with four adjustable concealed strike receivers within the door frame;

b) an attack, ballistic and blast resistant door with four interconnected concealed mortised bolt lock assemblies, each with a biased bolt, wherein one of the bolt lock assemblies has an engageable brake to hold all four interconnected biased bolts in retraction after a handle lever interconnected with the four biased blots is moved to a door open position so that the door maybe opened;

c) a roller assembly in the one bolt lock assembly biased to extend and move out from the door, when the door handle lever is moved into a door open position door, the brake holds all four interconnected biased bolts in retraction and the door maybe opened, the bolt lock assemblies are automatically armed when the door handle is moved to closed position, when the door is closed into the door frame the roller assembly depresses into the door and releases the brake and allows the biased bolts to automatically extend and move into the striker receivers and the extended bolts are concealed with in strike receivers in the door frame; and d) a manually adjustable ramp cut out on three sides on a strike plate cover over the strike receiver opposite of the one bolt lock assembly with the engageable brake, the ramp adjustably between a flat condition flush with the strike plate cover and a raised condition out of fiat condition when engaging the roller assembly to further move toward the door to adjustably and automatically release the brake smoothly to allow the biased bolts to properly and timely move into the strike receivers to secure and lock the door, with three additional strike plate covers and three strike plates for the other three strike receivers.

* * * * *